US012031103B2

(12) United States Patent
Coultas et al.

(10) Patent No.: US 12,031,103 B2
(45) Date of Patent: Jul. 9, 2024

(54) METHOD OF LIMITING CHEMICAL DEGRADATION DUE TO NITROGEN DIOXIDE CONTAMINATION

(71) Applicant: Infineum International Limited, Oxford (GB)

(72) Inventors: David Robert Coultas, Abingdon (GB); Matthew David Irving, Abingdon (GB); Nathan Hollingsworth, Abingdon (GB); Adam Greer, Abingdon (GB); Christopher Hardacre, Abingdon (GB)

(73) Assignee: INFINEUM INTERNATIONAL LTD, Abingdon (GB)

( * ) Notice: Subject to any disclaimer, the term of this patent is extended or adjusted under 35 U.S.C. 154(b) by 0 days.

(21) Appl. No.: 18/049,737

(22) Filed: Oct. 26, 2022

(65) Prior Publication Data

US 2023/0139253 A1 May 4, 2023

(30) Foreign Application Priority Data

Oct. 29, 2021 (EP) ..... 21205667

(51) Int. Cl.
*C10M 131/06* (2006.01)
*C10M 135/10* (2006.01)
(Continued)

(52) U.S. Cl.
CPC ..... *C10M 169/044* (2013.01); *C10M 131/06* (2013.01); *C10M 135/10* (2013.01);
(Continued)

(58) Field of Classification Search
CPC ..... C10M 169/044; C10M 131/06; C10M 135/10; C10M 137/10; C10M 137/12;
(Continued)

(56) References Cited

U.S. PATENT DOCUMENTS 3,024,195 A 3/1962 Drummond et al.
3,024,237 A 3/1962 Drummond et al.
(Continued)

FOREIGN PATENT DOCUMENTS

EP 2090642 A1 8/2009
WO 2008075016 A1 6/2008
(Continued)

OTHER PUBLICATIONS

European Search Report Application No. 21205654.3.
(Continued)

*Primary Examiner* — Prem C Singh
*Assistant Examiner* — Francis C Campanell
(74) *Attorney, Agent, or Firm* — Robert Migliorini

(57) ABSTRACT

An additive composition for limiting the chemical degradation of hydrocarbonaceous liquids due to nitrogen dioxide contamination at elevated temperature comprises the combination of an ionic liquid composed of a cation and a boron- and halogen-free, multi-functional anion and a detergent additive, the combination of ionic liquid and detergent serving to inhibit the nitration of hydrocarbonaceous liquid components that initiates degradation.

31 Claims, 2 Drawing Sheets

End-of-test oil kinematic viscosity (at 40°C) measured in the testing of Example 3.2

(51) Int. Cl.

| | |
|---|---|
| ***C10M 137/10*** | (2006.01) |
| ***C10M 137/12*** | (2006.01) |
| ***C10M 141/10*** | (2006.01) |
| ***C10M 149/10*** | (2006.01) |
| ***C10M 161/00*** | (2006.01) |
| ***C10M 169/04*** | (2006.01) |

(52) U.S. Cl.
CPC ..... *C10M 137/10* (2013.01); *C10M 137/12* (2013.01); *C10M 141/10* (2013.01); *C10M 149/10* (2013.01); *C10M 161/00* (2013.01); *C10M 2203/003* (2013.01); *C10M 2207/144* (2013.01); *C10M 2217/028* (2013.01); *C10M 2219/044* (2013.01); *C10M 2223/045* (2013.01); *C10M 2223/06* (2013.01)

(58) Field of Classification Search
CPC ..... C10M 141/10; C10M 149/10; C10M 161/00; C10M 2203/003; C10M 2207/144; C10M 2217/028; C10M 2219/044; C10M 2223/045; C10M 2223/06
USPC ..... 508/291
See application file for complete search history.

(56) References Cited

U.S. PATENT DOCUMENTS

| | | | | |
|---|---|---|---|---|
| 3,087,936 | A | 4/1963 | Le Suer | |
| 3,113,986 | A | 12/1963 | Breslow et al. | |
| 3,154,560 | A | 10/1964 | Osuch | |
| 3,172,892 | A | 3/1965 | Le Suer | |
| 3,202,678 | A | 8/1965 | Stuart et al. | |
| 3,216,936 | A | 11/1965 | Le Suer | |
| 3,219,666 | A | 11/1965 | Norman et al. | |
| 3,254,025 | A | 5/1966 | Le Suer | |
| RE27,145 | E | 6/1971 | Jones | |
| 3,634,595 | A | 1/1972 | Pasquali | |
| 3,670,054 | A | 6/1972 | De La Mare et al. | |
| 3,700,633 | A | 10/1972 | Wald et al. | |
| 6,153,565 | A | 11/2000 | Skinner et al. | |
| 6,191,081 | B1 * | 2/2001 | Cartwright | C10M 159/24 508/460 |
| 6,281,179 | B1 | 8/2001 | Skinner et al. | |
| 6,429,178 | B1 | 8/2002 | Skinner et al. | |
| 8,278,253 | B2 | 10/2012 | Habeeb | |
| 9,278,134 | B2 | 3/2016 | Rogers et al. | |
| 2008/0251759 | A1 | 10/2008 | Kalb et al. | |
| 2010/0084597 | A1 | 4/2010 | Schwab et al. | |
| 2010/0187481 | A1 | 7/2010 | Bodesheim et al. | |
| 2010/0216675 | A1 | 8/2010 | Habeeb | |
| 2012/0101012 | A1 * | 4/2012 | Delbridge | C10M 135/10 548/335.1 |
| 2012/0184474 | A1 | 7/2012 | Kawata et al. | |
| 2016/0024421 | A1 * | 1/2016 | Qu | C10M 171/00 562/606 |
| 2023/0139911 | A1 | 5/2023 | Coultas et al. | |
| 2023/0140105 | A1 | 5/2023 | Coultas et al. | |

FOREIGN PATENT DOCUMENTS

| | | | |
|---|---|---|---|
| WO | 2013158473 | A1 | 10/2013 |
| WO | 2022026432 | A1 | 3/2022 |

OTHER PUBLICATIONS

European Search Report Application No. 21205659.2.
European Search Report Application No. 21205667.5.
Reeves et al., CJ, Journal of Cleaner Production, "Tribological performance of environmental friendly ionic liquids for high-temperature applications," vol. 279, pp. 1-14, 2021, 123666.
Coultas, D.R. "The Role of NOx in Engine Lubricant Oxidation" SAE Technical Paper 2020-0101427, 2020. doi:10.4271/2020-01-1427.
American Petroleum Institute (API) publication "Engine Oil Licensing and Certification System", Industry Services Department, Fourteenth Edition, Dec. 1996, Addendum 1, Dec. 1998.

* cited by examiner

End-of-test oil kinematic viscosity (at 40°C) measured in the testing of Example 3.2

End-of-test oil toal acid number (TAN) measured in the testing of Example 3.2

METHOD OF LIMITING CHEMICAL DEGRADATION DUE TO NITROGEN DIOXIDE CONTAMINATION

PRIORITY CLAIM

This invention claims priority from European Patent Application EP21205667.5, filed Oct. 29, 2021, in the European Patent Office.

CROSS REFERENCE TO RELATED APPLICATIONS

This application is related to:

1) Concurrently filed USSN U.S. Ser. No. 18/049,733, entitled "Ionic liquid composition" and claiming priority to EP21205659.2, filed Oct. 29, 2021, in the European Patent Office; and 2) Concurrently filed USSN U.S. Ser. No. 18/049,730, entitled "Method of Limiting Chemical Degradation Due to Nitrogen Dioxide Contamination" and claiming priority to EP EP21205654.3, filed Oct. 29, 2021, in the European Patent Office.

FIELD OF THE INVENTION

The present invention concerns a method of limiting the chemical degradation of hydrocarbonaceous liquids due to nitrogen dioxide contamination in service at elevated temperatures. The method essentially comprises the addition to the hydrocarbonaceous liquid of an additive composition comprising a defined ionic liquid and detergent additive, the combination of ionic liquid and detergent serving to inhibit the nitration of the hydrocarbonaceous liquid by nitrogen dioxide which initiates the degradation.

BACKGROUND OF THE INVENTION

Hydrocarbonaceous liquids are used as service fluids in a variety of hardware applications, and in particular are used as lubricants, protective agents, hydraulic fluids, greases and heat transfer fluids for engineered parts and devices. The composition and properties of such liquids are selected for their intended application, and the ready availability of higher molecular weight hydrocarbonaceous species allows such fluids to be formulated for service at elevated temperatures, in particular above 100° C. where aqueous fluids cease to be usable.

Such hydrocarbonaceous liquids may typically be derived from petroleum or synthetic sources, or from the processing of renewable materials, such as biomaterials. In particular, hydrocarbonaceous lubricants and hydraulic fluids have become the standard in a variety of applications, including automotive and power transmission fluids, such as engine lubricating oils.

An essential performance attribute of service liquids is their ability to retain beneficial properties over their service life. The rigors of service place physical and chemical strains on the liquid, and limiting the resulting degradation of the liquid is a major consideration in their selection and formulation. Service fluids typically have to meet a number of performance requirements in their development and certification relating to maintaining service life, which expose the candidate liquids to testing under relevant service conditions which promote degradation.

Elevated service temperatures and the presence of chemically reactive contaminants increase the demands on hydrocarbonaceous liquids. Higher bulk liquid temperatures and the build-up of reactive contaminants can promote degradation reactions and cause serious reductions in service life, leaving the surrounding hardware inadequately served or protected by the liquid.

There exists in the art a general need to improve the service life of hydrocarbonaceous liquids operating at elevated bulk temperatures, and particularly of lubricants, by providing improved resistance to chemical degradation in the bulk under service conditions.

Degradation of hydrocarbonaceous liquids, especially at elevated bulk temperature, has typically been referred to in the art as 'oxidation', based on the conventional understanding that the chemical reactions responsible for degradation essentially involve the reaction of aging hydrocarbon species with oxygen, via a free-radical pathway involving peroxides formed in situ during service. The build-up of these species over time leads to increasing degradation of the liquid and deterioration in bulk liquid properties and service performance. A variety of additives conventionally designated 'antioxidants' have been proposed in the art to inhibit this oxidation pathway, including hydrocarbon-soluble hindered phenols and amines, slowing the resulting oxidative degradation that builds as the fluid ages in service.

However, work by the present applicant has characterised a different chemical degradation pathway that manifests itself in freshly prepared hydrocarbonaceous fluids lacking aged components. This degradation is initiated not by reaction with oxygen or peroxides, but from the direct chemical action at elevated temperatures of nitrogen dioxide which has become entrained in the liquid through contamination in service. It has been found that nitrogen dioxide initiates chemical degradation via nitration reactions with the hydrocarbonaceous liquid, and that these reactions result in substantial breakdown of the liquid in a process which commences when the liquid is still fresh. Nitrogen dioxide can also oxidise to nitric acid within the bulk liquid environment, and lead to acidic attack of the liquid and hardware it is designed to protect. Consequently, there is a specific need to limit the degradative effect of nitrogen dioxide contamination in hydrocarbonaceous liquids at elevated temperatures, which can cause deterioration at an early stage of service life and can also compound the issues caused by conventional oxygen-driven oxidation.

Such contamination by nitrogen dioxide occurs where the hydrocarbonaceous liquid is exposed to a source of nitrogen dioxide during service. Nitrogen dioxide (NO2) is formed through the reaction of naturally occurring nitrogen and oxygen in air when exposed to higher temperatures, often via the intermediate formation of nitrogen oxide (NO), for example during combustion reactions. Nitrogen dioxide is also a combustion product of fuels derived from petroleum or many bio-sources, both of which contain an amount of bound nitrogen, which is released as nitrogen dioxide upon complete combustion and can become entrained in service liquids in contact therewith. Such exposure is particularly prevalent in combustion devices, for example internal combustion engines, which generate nitrogen dioxide and are lubricated by hydrocarbonaceous liquids that become exposed to the exhaust gases; and in particular in crankcase lubricating oils, which experience direct contact with exhaust gases whilst resident on engine surfaces in the cylinder region, and also via blow-by exhaust gases which direct nitrogen dioxide past the piston rings into the crankcase oil reservoir, where it becomes entrained with the lubricant.

Modern engine and aftertreatment developments aimed at improving the fuel efficiency of engines and minimising carbonaceous particulate emissions have led to higher combustion temperatures, resulting in the production of higher nitrogen dioxide levels in engine-out exhaust gas by virtue of the effect known as the 'NOx—Particulate trade off'. The higher engine temperatures also result in higher bulk lubricant service temperatures, leading to conditions in which the chemical degradation initiated by nitrogen dioxide is increased.

In addition, the modern focus on increased fuel economy from internal combustion engines has resulted in designs in which internal friction is reduced by engineering greater clearances between the piston rings and cylinder liner surfaces, resulting in free-running engines in which more exhaust gas blows by the piston rings into the crankcase, where it becomes entrained in the bulk engine lubricant.

Accordingly, hydrocarbonaceous liquids exposed to contamination by nitrogen dioxide in service at elevated temperatures face a particular challenge, due to a chemical nitration pathway that takes effect early in the life of the liquid and is not initiated by the conventional oxidation of hydrocarbons. This challenge is especially severe in the case of engine lubricants, where a variety of engineering measures have increased the degree of nitrogen dioxide entrainment into the bulk lubricant at elevated operating temperatures. The applicant has determined that the resulting nitration pathway is particularly evident at bulk liquid temperatures of between 60 and 180° C., and particularly severe at bulk liquid temperatures of between 110 and 160° C., which temperatures are becoming more evident in crankcase lubricants used under severe operating conditions or in modern, hotter-running engine designs, thus exacerbating the impact of this chemical pathway on lubricant degradation.

The present invention provides a solution to this challenge through the deployment of a combination of defined ionic liquid and detergent additive having the particular co-operative ability to deactivate nitrogen dioxide, and thus inhibit the nitration of the hydrocarbonaceous liquid. Through this unexpected action, the defined combination of ionic liquid and detergent additive limits the chemical degradation initiated by nitration and improves the hydrocarbonaceous liquid's service life.

The present invention also provides unexpected control of oxidation in the oil particularly in the presence of dispersant additive, under conditions of nitrogen dioxide contamination where the dispersant appears to neutralise the effect of conventional phosphorus-based antioxidant.

One physical result of chemical degradation in hydrocarbonaceous service liquids is an increase in liquid viscosity during service. This viscosity increase can lead to the liquid no longer satisfying specified viscosity criteria, prompting its premature replacement. Deployment of the additive composition comprising the combination of ionic liquid and detergent additive defined in this invention provides the advantage of limiting the viscosity growth in service, reducing this consequent limitation to service life.

Many hydrocarbonaceous liquids, most notably lubricants such as engine lubricants, are formulated to control the increase in acidity which oxidation processes cause, due to the formation of acid species in the liquid, and subsequent acidic corrosion or wear. Consequently, it is a further advantage for such liquids to control the build-up of acid species over service life. Deployment of the additive composition comprising the combination of ionic liquid and detergent additive defined in this invention provides the advantage of better control of acid build-up in the liquid, offering the formulator this additional benefit in the preparation of improved service liquids.

The combination of ionic liquid and detergent additive defined in this invention thus provides advantages over conventional antioxidants and other ionic liquids previously contemplated in the art for use as additives in hydrocarbonaceous liquids, and offers an improved range of properties that enhance service liquid performance and service life. The co-presence of the detergent additive provides improved performance over the beneficial effect of the defined ionic liquid alone, and enables better service life and other benefits of the invention.

In a preferred embodiment, the combination of ionic liquid and detergent additive is deployed in conjunction with an ashless dispersant additive, this three-component combination providing particularly advantageous control of nitration arising from nitrogen dioxide contamination whilst enabling the use of dispersant for its beneficial effects.

U.S. Pat. No. 8,278,253 concerns enhancements in oxidation resistance of lubricating oils by the addition thereto of an additive amount of an ionic liquid. The description of the invention and Example 1 make clear that its method focusses on reducing hydroperoxide-induced oxidation, not the nitrogen-dioxide initiated degradation addressed by the present invention. A great variety of cations and anions are separately listed as possible constituents of the ionic liquid, of which the preferred anions and all anions in the examples are fluorine-containing, non-aromatic structures, the majority of which additionally comprise boron. This document does not disclose the defined cation-anion combination required for the ionic liquid of the present invention, and fails to teach its advantages for inhibiting nitration of fresh, un-aged oils by nitrogen dioxide and for improving other relevant properties.

WO-A-2008/075016 concerns an ionic liquid additive for non-aqueous lubricating oil compositions. The ionic liquid additive is directed towards reducing wear and/or modifying friction properties, and defined as a non-halide, non-aromatic ionic liquid, wherein the anion A− comprises at least one oxygen atom and has an ionic head group attached to at least one alkyl or alicyclic hydrocarbyl group. This document also fails to disclose the defined cation-aromatic anion combination required for the ionic liquid of the present invention, and fails to teach its advantages for inhibiting nitration of fresh, un-aged oils by nitrogen dioxide and for improving other relevant properties.

WO-A-2013/158473 concerns lubricant compositions comprising ionic liquids and methods of using such compositions, targeted at minimising deposit and sludge formation in internal combustion engines. The worked examples target high temperature deposit formation that takes place after pre-test aging of the lubricating oil, in which fresh oil is blended with a substantial quantity of used lubricant, as well as being sparged with a dry air/nitrogen dioxide mixture, followed by a deposit-generating step on a metal surface heated to at least 200° C., and optimally to 320° C., whilst being exposed to simulated exhaust gases. The ionic liquid comprises a list of nitrogen-containing cations and an anion represented by the structure YCOO(−) wherein Y is alkyl or aromatic, preferably an alkyl or alkoxyl functional group having from 1 to 50 carbon atoms, or a benzene group, or an alkylated benzene group wherein said alkyl group(s) have 1 to 10 carbon atoms. This document fails to disclose the defined cation-anion combination of the ionic liquid deployed in the present invention, and fails to teach its advantage of inhibiting nitration of fresh, un-aged oils by nitrogen dioxide at bulk liquid temperatures below 200° C., and for improving other relevant properties.

US-A-2010/0187481 concerns the use of ionic liquids for improving the lubricating effect of synthetic, mineral or native oils. The invention discloses that the resulting lubricant composition is protected from thermal and oxidative attack. The ionic liquid is said to be superior to phenol-based or amine-based antioxidants as thermal and oxidative stabilisers, due to their solubility in organic systems or extremely low vapour pressure. The preferred anions of the ionic liquid are highly fluorinated for high thermal stability, such as bis(trifluoromethylsulfonyl)imide, and no mention or insight into the control of nitrogen-dioxide initiated degradation is provided.

The applicant has now found that deploying additive quantities of the combination of an ionic liquid composed of defined cations and defined halogen-, sulfur- and boron-free anions and a detergent additive comprising, as active ingredient, one or more hydrocarbyl-substituted neutral or overbased metal salts serves to inhibit the nitration of hydrocarbonaceous liquid due to nitrogen dioxide contamination at elevated temperature, and provides a method of limiting the chemical degradation of hydrocarbonaceous liquids even when fresh and un-aged by service. This method enables longer life from service liquids experiencing such contamination, and provides additional advantages over the prior art as detailed herein.

SUMMARY OF THE INVENTION

In a first aspect, the present invention provides an additive composition for hydrocarbonaceous liquids, the additive composition comprising an ionic liquid and a detergent additive, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and the detergent additive comprising, as active ingredient, one or more neutral or overbased hydrocarbyl-substituted metal salts; the additive composition further comprising a carrier liquid or diluent.

In a second aspect, the present invention provides a hydrocarbonaceous liquid composition comprising a major amount of hydrocarbonaceous liquid and minor amounts of an ionic liquid and a detergent additive, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and the detergent additive comprising, as active ingredient, one or more neutral or overbased hydrocarbyl-substituted metal salts.

In a third aspect, the present invention provides a method of limiting the chemical degradation of a hydrocarbonaceous liquid in service at bulk liquid temperatures of between 60 and 180° C., the degradation being initiated by nitration of the liquid resulting from contamination with nitrogen dioxide in service, comprising:

preparing, or obtaining a freshly prepared, hydrocarbonaceous liquid suitable for service at bulk liquid temperatures of between 60 and 180° C. and being free of aged components and nitrogen dioxide contamination;

adding to said hydrocarbonaceous liquid, prior to service at bulk liquid temperatures of between 60 and 180° C., an ionic liquid and a detergent additive, wherein:

the ionic liquid is composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and wherein the detergent additive comprises, as the active ingredient, one or more hydrocarbyl-substituted neutral or overbased metal salts;

wherein the ionic liquid and detergent active ingredient are added in amounts that are co-operatively effective to thereafter inhibit the nitration of the hydrocarbonaceous liquid in service at bulk liquid temperatures of between 60 and 180° C., in the presence of nitrogen dioxide contamination; and putting said hydrocarbonaceous liquid into service, wherein the ionic liquid and detergent additive thereby limit the resulting chemical degradation of the liquid.

In a fourth aspect, the present invention provides the co-operative use of an ionic liquid and a detergent additive, wherein the ionic liquid is composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and wherein the detergent additive comprises, as the active ingredient, one or more hydrocarbyl-substituted neutral or overbased metal salts;

to limit the chemical degradation of a hydrocarbonaceous liquid in service at bulk liquid temperatures of between 60 and 180° C., the degradation being initiated by nitration of the hydrocarbonaceous liquid resulting from contamination with nitrogen dioxide during service; wherein the ionic liquid and detergent additive are added to the hydrocarbonaceous liquid free of aged components and nitrogen dioxide prior to service, and wherein the ionic liquid and detergent active ingredient thereafter inhibit the nitration of the hydrocarbonaceous liquid in service at bulk liquid temperatures of between 60 and 180° C. in the presence of nitrogen dioxide contamination.

In a fifth aspect, the present invention provides the use of a detergent additive comprising, as the active ingredient, one or more hydrocarbyl-substituted neutral or overbased metal salts, to increase the efficacy of an ionic liquid additive for inhibiting the nitration of a hydrocarbonaceous liquid in service at bulk liquid temperatures of between 60 and 180° C. and resulting from contamination with nitrogen dioxide in service, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

wherein the detergent additive is added to the hydrocarbonaceous liquid containing the ionic liquid additive prior to service at bulk liquid temperatures of between 60 and 180° C. and exposure to nitrogen dioxide contamination.

Further aspects of the invention include the co-operative use of an ionic liquid and a detergent additive in a hydrocarbonaceous liquid, wherein the ionic liquid is composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and wherein the detergent additive comprises, as the active ingredient, one or more hydrocarbyl-substituted neutral or overbased metal salts;

wherein the use is for:

(a) inhibiting the chemical oxidation of the hydrocarbonaceous liquid in service at bulk liquid temperatures of between 60 and 180° C. in the presence of contamination with nitrogen dioxide during service; and/or (b) for inhibiting the increase in kinematic viscosity of the hydrocarbon liquid in service at bulk liquid temperatures of between 60 and 180° C. in the presence of contamination with nitrogen dioxide during service; and/or (c) for inhibiting the increase in total acid number of the hydrocarbon liquid in service at bulk liquid temperatures of between 60 and 180° C. in the presence of contamination with nitrogen dioxide during service;

and wherein, in each use, the ionic liquid and detergent additive are added to the hydrocarbonaceous liquid free of aged components and nitrogen dioxide prior to service, and wherein the ionic liquid and detergent active ingredient thereafter inhibit their effects in the hydrocarbonaceous liquid in service at bulk liquid temperatures of between 60 and 180° C. in the presence of nitrogen dioxide contamination.

Preferably, the compositions of the first and second aspects additionally comprise an ashless dispersant additive. Also preferably, the method and uses of each of the remaining aspects are deployed in the additional presence of an ashless dispersant additive.

Preferred embodiments of these various aspects of the invention are described hereafter.

BRIEF DESCRIPTION OF THE DRAWINGS

This specification also makes reference to the following FIGURES, wherein.

DETAILED DESCRIPTION

Figure 1:
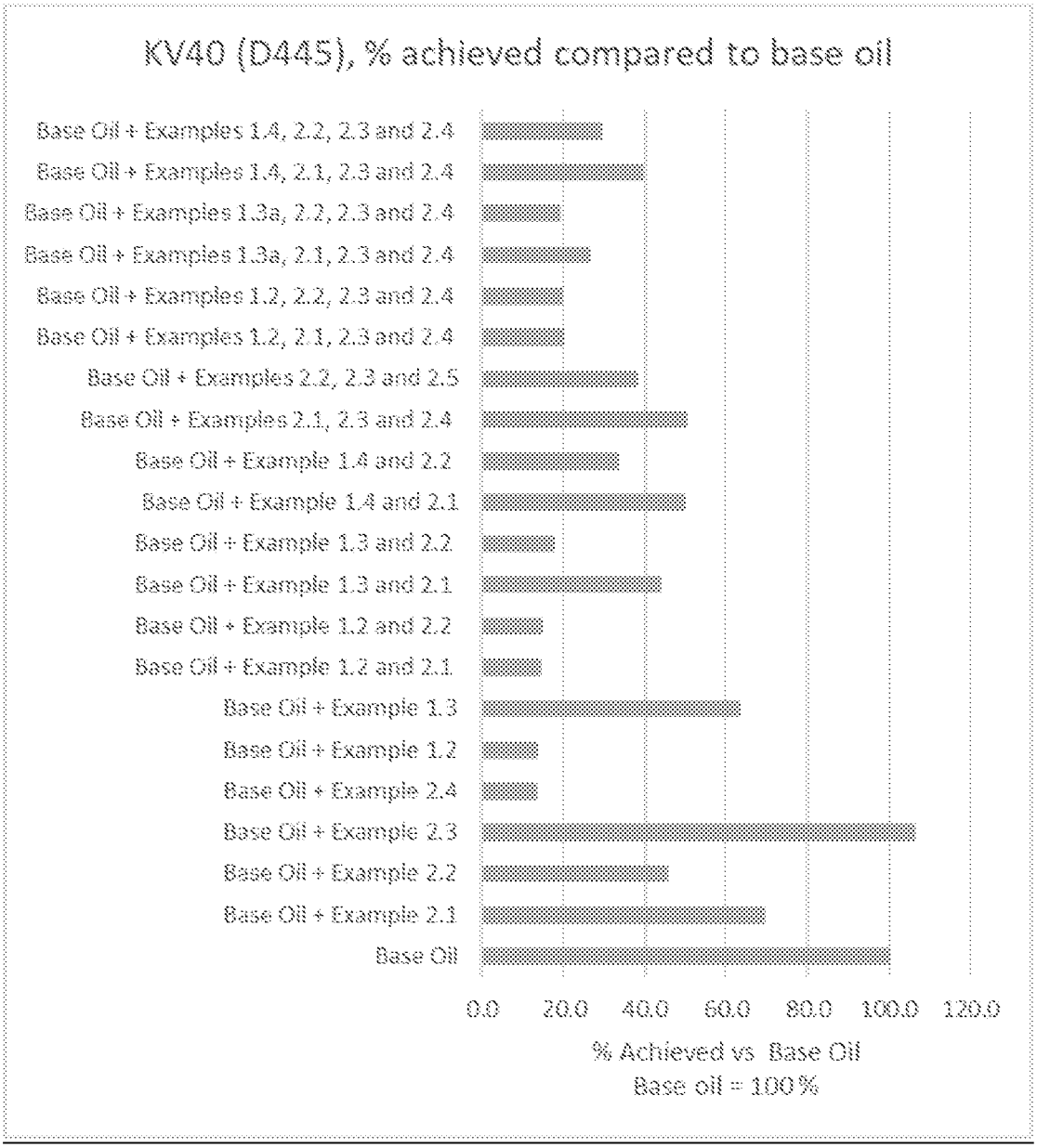
FIG. 1 illustrates the end-of-test kinematic viscosity results achieved by lubricating oil compositions containing ionic liquids and other additives during the tests detailed in Example 3.2 hereinafter.
Figure 2:
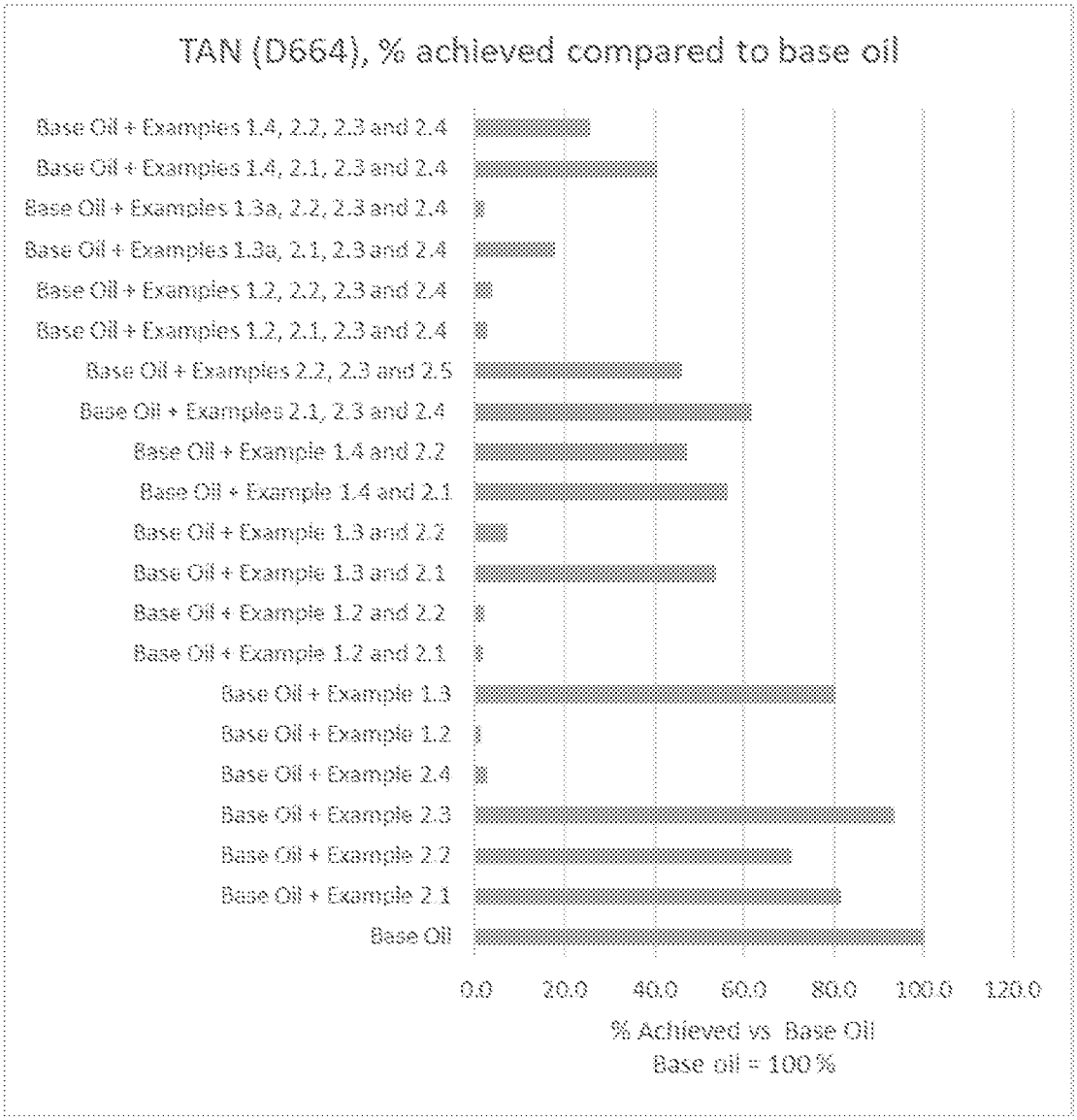
FIG. 2 illustrates the end-of-test total acid numbers of lubricating oil compositions containing ionic liquids during the tests detailed in Example 3.3 hereinafter.

It will be understood that various components used, essential as well as optional and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention. Accordingly, preferred and more preferred features of one aspect of the present invention may be independently combined with other preferred and/or more preferred features of the same aspect or different aspects of the present invention.

The importance of nitrogen dioxide-initiated degradation in fresh lubricant at elevated temperature has recently been reported by the applicant in the Paper cited as Coultas, D. R. "The Role of NOx in Engine Lubricant Oxidation" SAE Technical Paper 2020-0101427, 2020. doi:10.4271/2020-01-1427. This paper notes in its introduction that "The principal mechanism by which NOx degrades the lubricant is through its involvement in free-radical nitro-oxidation reactions." The equations which follow show that nitrogen dioxide initiates the process via abstraction of a proton from liquid hydrocarbon species, setting in motion a sequence of reactions involving other species and leading to chemical degradation of the hydrocarbonaceous liquid. Nitrogen dioxide also features prominently further down this degradation pathway, by reacting with RO·radicals to form hydrocarbonaceous nitrate esters of the formula RONO2. These accumulate in the lubricant, forming a reservoir of nitrate esters. At higher operating temperatures, these nitrate esters increasingly dissociate to release the captured RO·radicals, leading to the characteristic nitrate ester "volcano curve" pictured in FIG. 14 of this Paper. This rapid dissociation of nitrate esters into free radicals accelerates the chemical breakdown of the hydrocarbonaceous species in the liquid. This plurality of reactions involving nitrogen dioxide, including both initial proton abstraction and the dissociation of subsequently formed nitrate esters, is herein referred to as "nitration" of the hydrocarbonaceous liquid.

The initiation of this nitration reaction pathway through proton abstraction by nitrogen dioxide, and the formation and dissociation of a reservoir of nitrate esters in the further action of nitrogen dioxide, have been determined by the applicant to be a function of elevated bulk liquid temperature. The initiation of the nitration reaction sequence is underway at 60° C., and grows at higher temperatures of 80° C. and above. The formation of nitrate ester builds significantly in the range of 110 to 180° C., and from 130° C. the dissociation rate of nitrate esters increases. In the temperature range of 110 to 160° C., the production and dissociation of nitrate ester is most pronounced and leads to more chemical degradation of the hydrocarbonaceous liquid. The trend to higher bulk liquid (sump) temperatures in modern engine lubricants (to temperatures of 130° C. and higher) thus increases the practical consequences of nitrogen dioxide contamination, and renders the lubricants of these engines more susceptible to this form of degradation.

Without being bound to a particular theory, the applicant believes from technical investigations that the ionic liquid and detergent additive deployed in this invention have a particular co-operative ability to deactivate nitrogen dioxide present as a contaminant in hydrocarbonaceous liquids. Consequently, the nitrogen dioxide is inhibited from reacting with hydrocarbonaceous liquid species and initiating degradation via proton abstraction to begin the nitration reaction pathway. The nitrogen dioxide is further inhibited from reacting to form the nitrate esters that produces the volcano curve at higher temperatures and its eruption of radicals that leads to further degradation.

In particular, the applicant has found that the co-addition of a detergent additive comprising, as active ingredient, one or more hydrocarbyl-substituted neutral or overbased metal salts, increases the efficacy of a defined ionic liquid to deactivate nitrogen dioxide, and further inhibits the nitration of a hydrocarbonaceous liquid subject to elevated temperatures and nitrogen dioxide contamination. This advantageous effect is seen to result from the combination of the ionic liquid and detergent in the hydrocarbonaceous liquid, and allows lower levels of nitration to be obtained in service.

Furthermore, the applicant has found the preferred ionic liquid deployed in this invention (comprising the preferred aromatic carboxylate embodiment of the anion) in combination with the defined detergent of this invention to have superior affinity for nitrogen dioxide, especially at comparable viscosity, as compared with other ionic liquids. The applicant has also demonstrated the correspondingly improved ability of this invention when comprising this preferred ionic liquid to inhibit nitration of hydrocarbonaceous liquids under service conditions subject to elevated temperatures, and to inhibit the growth in bulk liquid acidity over time.

The other benefits in service conditions for the present invention in inhibiting oxidation, viscosity increase, and total acid number are demonstrated in the worked examples later in this specification.

The Ionic Liquid Deployed in all Aspects of the Invention

An ionic liquid is conventionally understood as an ionic compound, composed of one or more cation-anion pairs, which exists in liquid physical form at industrially useful temperatures. All aspects of the present invention deploy a defined ionic liquid composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge.

The one or more cations (i) carry the cationic (positive) charge and comprise multiple hydrocarbyl substituents providing organophilic character to the ionic liquid, enabling it to mix readily with hydrocarbonaceous bulk liquid.

In this specification the term "hydrocarbyl substituents" refer to groups which contain hydrogen and carbon atoms and are each bonded to the remainder of the compound directly via a carbon atom. The group may contain one or more atoms other than carbon and hydrogen (i.e., heteroatoms) provided they do not affect the essentially hydrocarbyl nature of the group, namely oxygen and nitrogen atoms; such groups include amino nitro and alkoxyl groups. Preferably, however, the hydrocarbyl group consists essentially of, and more preferably consists of, hydrogen and carbon atoms unless specified otherwise. Preferably, the hydrocarbyl group is or comprises an aliphatic hydrocarbyl group. The term "hydrocarbyl" encompasses the term "alkyl" as conventionally used herein. Preferably, the term "alkyl" means a radical of carbon and hydrogen (such as a C1 to C30, such as a C4 to C20 group). Alkyl groups in a compound are typically bonded to the compound directly via a carbon atom. Unless otherwise specified, alkyl groups may be linear (i.e., unbranched) or branched, be cyclic, acyclic or part cyclic/acyclic. The alkyl group may comprise a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl. Substituted alkyl groups are alkyl groups where a hydrogen or carbon has been replaced with a heteroatom (i.e., not H or C) or heteroatom containing group. The term "substituted" generally means that a hydrogen has been replaced with a carbon or heteroatom containing group.

In a first embodiment, one or more of the cations (i) of the ionic liquid may contain nitrogen. In this embodiment it is preferred that each cation (i) is a hydrocarbyl-substituted ammonium cation, or a hydrocarbyl-substituted alicyclic or aromatic ring system incorporating nitrogen and bearing the cationic charge.

In this first embodiment of the cation, it is preferred that each cation (i) is a hydrocarbyl-substituted ammonium cation, preferably a tetra-hydrocarbyl substituted ammonium cation. In this embodiment it is preferred that the hydrocarbyl groups are alkyl groups. The alkyl groups suitable as substituents for such ammonium cations include those straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such phosphonium cations include hexyl, octyl, decyl, dodecyl, tetradecyl, hexadecyl, and octadecyl groups, and especially where n-alkyl groups. Preferably at least one of the alkyl substituents contains at least 10 carbon atoms and is selected from the above examples. Some of the alkyl substituents may be lower in carbon number, such as methyl groups. Most preferably in this embodiment, each cation (i) is a tetrabutyl ammonium cation, i.e., a cation carrying four butyl groups as substituents, these substituents preferably being linear groups. Such a cation is sometimes known in the industry by the shorthand term 'N4444' wherein the numbers relate the carbon numbers (4,4,4,4) of the four butyl groups respectively. Other most preferred cation examples are tetraoctyl ammonium (N8888)), trihexyltetradecyl ammonium ((N66614), and trimethyletradecyl (N11114) or trimethylhexadecyl (11116) ammonium.

However, in a second, more preferred embodiment of the cation, each cation (i) of the ionic liquid is nitrogen-free. The ionic liquids of this embodiment have been found to be more advantageous in the present invention. They also provide a reduced contribution to nitrogen dioxide emissions when consumed, for example where the hydrocarbonaceous liquid is itself subject to combustion, such as where lubricating oil is consumed in an engine.

It is further preferred in this second embodiment that each cation (i) of the ionic liquid consists of a tetra-hydrocarbyl substituted central atom or ring system bearing the cationic charge. The hydrocarbyl groups may be the same or different and may be linear, branched, or cyclic. The hydrocarbyl groups are typically alkyl groups (such as linear or branched alkyl groups). In embodiments, the alkyl groups are the same alkyl, such as straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such cations include butyl, hexyl, octyl, decyl, dodecyl, tetradecyl, hexadecyl, and octadecyl groups, and especially where n-alkyl groups.

Most preferably, each cation (i) of the ionic liquid is a phosphorus-containing cation.

In this embodiment, it is preferred that each cation (i) is an alkyl substituted phosphonium cation, ideally a tetra-alkyl substituted phosphonium cation. The alkyl groups suitable as substituents for such phosphonium cations include those straight- or branched-chain alkyl groups containing 1 to 28 carbon atoms, such as 4 to 28 carbon atoms, preferably 6 to 28 carbon atoms, more preferably 6 to 14 carbon atoms. Particularly suitable alkyl substituents for such phosphonium cations include hexyl, octyl, decyl, dodecyl, tetradecyl, hexadecyl and octadecyl groups, and especially where n-alkyl groups. Preferably at least one of the alkyl substituents contains at least 10 carbon atoms and is selected from the above examples.

Most preferably, each cation (i) is a trihexyltetradecyl phosphonium cation, i.e., a cation carrying three hexyl and one tetradecyl groups as substituents, these substituents preferably being linear alkyl groups. Such a group is sometimes known in the industry by the shorthand term 'P66614' wherein the numbers relate the carbon numbers (6,6,6,14) of the three hexyl and one tetradecyl groups respectively.

The one or more halogen-, sulfur- and boron-free anions (ii) each comprise one or more hydrocarbyl groups and one or more heteroatom-containing functional groups bearing a localised or delocalised anionic charge. One or more anions (ii) may contain nitrogen atoms, particularly in the form of a nitrate or nitrogen-containing organic ring structure, but preferably, each of the anions (ii) is nitrogen-free.

In a preferred embodiment, one or more anions (ii), and preferably each anion (ii), comprises a carboxylate functional group, this group bearing the anionic charge.

In a first carboxylate embodiment, the one or more hydrocarbyl groups attached to the carboxylate group are aliphatic groups and preferably consist of carbon and hydrogen atoms, and are more preferably alkyl groups, such as C3 to C27 alkyl groups, preferably C5 to C17 alkyl groups, preferably n-alkyl groups. Such preferred anions (ii) especially include hexanoate, octanoate, decanoate, dodecanoate, tetradecanoate, hexadecanoate and octadecanoate anions. Such carboxylate anions (ii) may advantageously comprise a further heteroatom-containing functional group, preferably an oxygen-containing functional group, such as a hydroxy group.

In a second, more preferred carboxylate embodiment, one or more anions (ii), and more preferably all anions (ii), comprise a hydrocarbyl group being an aromatic ring, bearing at least two substituent functional groups containing heteroatoms, these functional groups being conjugated with the aromatic ring, and this conjugated system bearing the anionic (negative) charge. In this specification, the term "conjugated" is used in its conventional chemical sense to mean these substituent functional groups are bonded directly to the aromatic ring, wherein one or more p orbitals of one or more atoms comprised within each of these functional groups link to the p orbitals of the adjacent aromatic ring to participate in the delocalised electron cloud of the aromatic ring. It is believed that anions of this preferred configuration have a particular affinity for nitrogen dioxide, and are able to bind to it in such a way that its reactivity towards hydrocarbonaceous compounds is significantly reduced.

The aromatic ring is composed of carbon and optionally one or more heteroatoms such as nitrogen or oxygen. However, it is preferred that each anion (ii) of the ionic liquid is nitrogen-free. Such ionic liquids have been found to be more advantageous in the present invention, and cannot make a contribution to nitrogen dioxide formation in environments where a proportion of the ionic liquid will be consumed by combustion, for example in engine lubricant environments.

In a first advantageous form of this preferred embodiment of the anion, the aromatic ring of each anion (ii) bears two conjugated substituent functional groups containing heteroatoms, this system bearing the anion (negative) charge. This feature is preferably provided by the aromatic ring of each anion (ii) of the ionic liquid bearing a carboxylate group and a further heteroatom-containing functional group bonded directly to the aromatic ring, this system bearing the anionic charge. It is more preferred that the heteroatom(s) in both these functional groups consist of oxygen atoms. These functional groups are more preferably positioned on adjacent ring carbon atoms in 'ortho' configuration to each other on the aromatic ring.

In this embodiment of the anion, it is highly preferred that each anion (ii) is a disubstituted benzene ring bearing a carboxylate group and a second hetero-atom-containing functional group containing only oxygen as the heteroatom, these two groups preferably being positioned in 'ortho' configuration to each other on the aromatic ring. It is preferred that the second functional group is a hydroxyl group, giving rise to a hydroxybenzoate anion (ii). Most preferably the one or more anions (ii) of the ionic liquid are one or more salicylate anions, i.e., anions formed from the deprotonation of salicylic acid.

In a second, more advantageous form of this preferred embodiment of the anion, the aromatic ring itself of each anion (ii) of the ionic liquid bears the substituent groups of the first advantageous form of the anion, preferably those of the preceding two paragraphs, and additionally bears one or more hydrocarbyl substituents. These hydrocarbyl substituents provide additional organophilic character to the ionic liquid, enabling it to mix more readily with hydrocarbonaceous bulk liquid.

The additional hydrocarbyl substituent(s) on the aromatic ring of this second embodiment of the anion are as previously defined. Preferably, these substituent(s) are alkyl substituents. Suitable alkyl groups include those straight- or branched-chain alkyl groups containing 6 or more carbon atoms, preferably 6 to 28 carbon atoms, more preferably 6 to 14 carbon atoms. Particularly suitable alkyl substituents include hexyl, octyl, decyl, dodecyl, tetradecyl, hexadecyl and octadecyl groups, and especially where n-alkyl groups.

The aromatic ring of this second embodiment of anion (ii) may bear a single alkyl substituent or multiple alkyl substituents. The consequent ionic liquid may be composed of a mixture of anions (ii) differing in their number and/or position of alkyl substituents, which are preferably selected from the above-specified alkyl substituents. Preferably at least one of the alkyl substituents contains at least 10 carbon atoms and is selected from the above examples. More preferably, the aromatic ring of each anion (ii) of the ionic liquid bears one or more straight- or branched-chain alkyl substituents having more than 10 carbon atoms.

In the second, more preferred embodiment of the anion, one or more anions (ii) are preferably hydrocarbyl-substituted hydroxybenzoates of the structure:

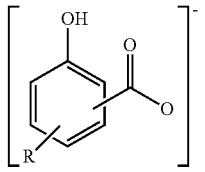

wherein R is a linear or branched hydrocarbyl group, and more preferably an alkyl group as defined above, including straight- or branched-chain alkyl groups. There may be more than one R group attached to the benzene ring. The carboxylate group and hydroxyl group are conjugated to the aromatic ring, and this system bears the negative (anionic) charge. The carboxylate group can be in the ortho, meta or para position with respect to the hydroxyl group; the ortho position is preferred. The R group can be in the ortho, meta or para position with respect to the hydroxyl group.

In the second embodiment of the anion, one or more anions (ii) of the ionic liquid are most preferably one or more alkyl-substituted salicylate anions, wherein the alkyl substituent(s) of each anion are independently selected from alkyl groups containing from 12 to 24 carbon atoms; and more preferably from dodecyl, tetradecyl, hexadecyl and octadecyl groups.

Such hydroxybenzoate and salicylate anions are typically prepared via the carboxylation, by the Kolbe-Schmitt process, of phenoxides, and in that case, will generally be obtained (normally in a diluent) in admixture with uncarboxylated phenol.

In both the first and second preferred embodiments of the anion (ii), it is preferred that each anion (ii) is nitrogen-free.

The ionic liquid is preferably composed of one or more cations (i) and one or more anions (ii) drawn from the above embodiments. In particular, the ionic liquid may preferably be composed of the first embodiment of the cation (i) in combination with either the first or second carboxylate embodiment of the anion (ii), or a mixture thereof. More preferably, the ionic liquid is composed of the second embodiment of the cation (i) in combination with either the first or second carboxylate embodiment of the anion (ii), or a mixture thereof.

Most preferably, the ionic liquid is composed of the second embodiment of the cation (i) in combination with the second carboxylate embodiment of the anion (ii). Such ionic liquids show especially high affinity for nitrogen dioxide, and provide particular advantages when deployed according to the various aspects of the invention. It is most preferred in this combination that each cation (i) and anion (ii) is nitrogen-free.

In particular, ionic liquids are preferred in which each cation (i) is nitrogen-free and consists of a tetra-hydrocarbyl substituted central atom or ring system bearing the cationic charge, and each anion (ii) comprises an aromatic ring bearing a carboxylate group and a further heteroatom-containing functional group, and an additional hydrocarbyl substituent, as hereinbefore described. The preferred examples described hereinbefore for each such cation (i) and anion (ii) are particularly useful in combination. It is more preferred for the anion (ii) that the heteroatom(s) in both these functional groups consist of oxygen atoms. These functional groups are most preferably positioned on adjacent ring carbon atoms in 'ortho' configuration to each other on the aromatic ring.

In all the preferred ionic liquids, and especially the ionic liquids of the three preceding paragraphs, each cation (i) is most preferably an alkyl substituted phosphonium cation, ideally a tetra-alkyl substituted phosphonium cation as hereinbefore described. The trihexyltetradecyl-phosphonium cation (P66614 cation) is most preferred.

The ionic liquid of all aspects of the invention may be prepared by synthetic routes known in the art, chosen by the skilled person according to conventional synthesis criteria with regard to suitability for the desired cation-anion combination.

Thus, in ionic liquids comprising the first embodiment of the cation (i), this cation can for example be formed by alkylation or arylation, and preferably alkylation, of the corresponding amine or nitrogen-containing ring compound using a nucleophilic substitution reaction with an alkyating or arylating agent that may for example by an alkyl or arylhalide, preferably an alkyl halide. The resulting cation-halide complex may thereafter be mixed with the desired stoichiometric amount of a metal salt of the desired anion (ii), typically in a dry organic solvent selected to solubilise the desired ionic liquid but precipitate the metal halide formed after anion exchange. An anion exchange resin may be adopted to promote the exchange reaction.

In ionic liquids comprising the second embodiment of the cation (i), this liquid can likewise be formed from the cation-halide complex of the desire cation (ii), such as the preferred phosphonium cation, which is then subjected to anion exchange in a suitable solvent with the precursor of the desired anion. Again an anion exchange resin may be employed to promote the exchange. The solvent is then stripped and the ionic liquid recovered.

Examples of synthetic methods for ionic liquids are provided in US-A-2008/0251759 and in the worked examples detailed later in this specification. In addition, the individual cations and anions or precursors thereto are available as items of chemical commerce.

Without being bound to a particular theory, the applicant believes that the particular advantages of the combination of ionic liquid and detergent defined in this invention in deactivating the degradative effects of nitrogen dioxide arises from the ionic liquid's composition and elucidated mechanism of action, which is potentiated or facilitated by the detergent in such a way that the efficacy of the ionic liquid is increased.

Firstly, the anion (ii) in the ionic liquid ion-pair is capable of interacting with nitrogen dioxide molecules, effectively removing them from reactive circulation within the hydrocarbonaceous liquid. Consequently, the initial deprotonation of hydrocarbonaceous components in the bulk liquid is inhibited, and the nitration reaction sequence and formation of nitrate esters is likewise inhibited, resulting in a slower degradation of the bulk liquid over time.

Secondly, it is postulated that nitric acid formed in situ from the oxidation of some bound nitrogen dioxide is captured by the associated cation of the ionic liquid. This nitric acid loses its acidic proton to the negatively charged anion-nitrogen dioxide complex, resulting in the formation of an ion-pair comprising the ionic liquid cation and nitrate anion, and a further stable complex between the protonated anion and remaining bound nitrogen dioxide. This sequence effectively also locks away the nitric acid from reactive circulation within the hydrocarbonaceous liquid. As a result, the build-up of acid over time in the hydrocarbonaceous liquid is also slower, and the ionic liquid helps to contain acid-mediated oxidation and acidic attack of the hydrocarbonaceous liquid and the underlying hardware.

In this way, the cation and anion of the ionic liquid act in combination to inhibit the degradative consequences of nitrogen dioxide contamination of the hydrocarbonaceous liquid and prolong service life.

The observable benefit arising from the co-presence of detergent is attributed to the ability of the detergent to act as a proton-transfer agent during the formation of the ion pair between ionic liquid cation and nitrate anion, thereby facilitating the formation of the further complex between the protonated anion and remaining bound nitrogen dioxide. In this way the detergent co-operates with the ionic liquid to lock away the nitrogen dioxide from reactive circulation within the hydrocarbonaceous liquid, and leads to greater inhibition of nitration during service.

The Detergent Deployed in all Aspects of the Invention

The detergent additive comprises, as active ingredient, one or more neutral or overbased hydrocarbyl-substituted metal salts. The remainder of the detergent composition is suitably solvent or carrier fluid, optionally containing minor amounts of ancillary materials such as compatibilisers or anti-foaming agents.

Metal-containing (or "ash-forming") detergents generally comprise a polar head with a long hydrophobic tail. The polar head comprises a metal salt of an acidic organic compound. The salts may contain a substantially stoichiometric amount of the metal in which case they are usually described as normal or neutral salts, and have a total base number or TBN (as can be measured by ASTM D2896) of from 0 to less than 150, such as 0 to about 80 or 100. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents have a TBN (mg KOH/g) of 150 or greater, and will preferably have, or have on average, a TBN of at least about 200, such as from about 200 to about 500; preferably at least about 250, such as from about 250 to about 500; more preferably at least about 300, such as from about 300 to about 450.

In all aspects of the present invention, the detergent active ingredient preferably is, or comprises, one or more neutral or overbased metal salts of one or more hydrocarbyl-substituted aromatic acids or phenols. Such preferred active ingredients that may be deployed in all aspects of the present invention include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

More preferably the detergent active ingredient is, or comprises, one more neutral or overbased metal salts of one or more hydrocarbyl-substituted benzene sulfonic acids. Such sulfonic acids are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

The detergent may also preferably comprise or consist of, as active ingredient, one or more metal salts of hydrocarbyl-substituted phenols or sulfurized phenols prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Most preferably the detergent active ingredient is, or comprises, one or more neutral or overbased metal salts of one or more hydrocarbyl-substituted carboxylic acids, and more preferably one or more neutral or overbased metal salts of one or more hydroxybenzoic acids.

Such carboxylate detergents can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain hetero atoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

In all aspects of the invention, it is particularly preferred that the detergent active ingredient is one or more alkaline earth metal salts of alkyl-substituted salicylic acids, and most preferably one or more magnesium salts of alkyl-substituted salicylic acids. In both such embodiments, the alkyl substituent(s) of each salicylic acid salt constituting the detergent active ingredient are most preferably independently selected from alkyl groups containing from 9 to 30, especially 14 to 20, carbon atoms.

Detergents comprising magnesium salts are preferred in the practice of the invention. In all aspects of the invention, the magnesium detergent may be the sole metal-containing detergent, in which case 100% of the metal introduced into the lubricating oil composition by detergent will be magnesium. Where overbased or neutral detergents based on metals other than magnesium are employed, preferably at least about 30 mass %, more preferably at least about 40 mass %, particularly at least about 50 mass % of the total amount of metal introduced into the lubricating oil composition by detergent will be magnesium.

Detergents generally useful in the formulation of lubricating oil compositions also include "hybrid" detergents formed with mixed surfactant systems, e.g., phenate/salicylates, sulfonate/phenates, sulfonate/salicylates, sulfonates/phenates/salicylates, as described, for example, in U.S. Pat. Nos. 6,153,565; 6,281,179; 6,429,178; and 6,429,178.

The Hydrocarbonaceous Liquid Deployed in the Second, Third, Fourth and Fifth and Other Aspects of the Invention The hydrocarbonaceous liquid used as the bulk service liquid in these aspects of the invention may be derived from petroleum or synthetic sources, or from the processing of biomaterials.

Where the hydrocarbonaceous liquid is a petroleum oil, and especially a lubricating oil, such oils range in viscosity from light distillate mineral oils to heavy lubricating oils such as gasoline engine oils, mineral lubricating oils and heavy duty diesel oils. Generally, the kinematic viscosity of the oil ranges from about 2 mm2/sec (centistokes) to about 40 mm2/sec, especially from about 3 mm2/sec to about 20 mm2/sec, most preferably from about 9 mm2/sec to about 17 mm2/sec, measured at 100° C. (ASTM D445-19a).

Suitable oils, especially as lubricating oils, include natural oils such as animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful bulk oils.

Synthetic oils, and especially synthetic lubricating oils, include hydrocarbon oils and halo-substituted hydrocarbon oils retaining hydrocarbonaceous character, such as polymerized and copolymerized olefins (e.g., ethylene-propylene copolymers, polybutylene homo- and copolymers, polypropylene homo and copolymers, propylene-isobutylene copolymers, chlorinated polybutylenes, poly(l-hexenes), poly(l-octenes), poly-n-decenes (such as decene homopolymers or copolymers of decene and one or more of C8 to C20 alkenes, other than decene, such as octene, nonene, undecene, dodecene, tetradecene and the like); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof. Also useful are synthetic oils derived from a gas to liquid process from Fischer-Tropsch synthesized hydrocarbons, which are commonly referred to as gas to liquid, or "GTL" base oils.

Esters are useful as synthetic oils having hydrocarbonaceous character, and include those made from C5 to C12 monocarboxylic acids and polyols and polyol esters such as neopentyl glycol, trimethylolpropane, pentaerythritol, dipentaerythritol and tripentaerythritol.

Where the hydrocarbonaceous liquid is a lubricating oil, it may comprise a Group I, Group II, Group III, Group IV, or Group V base stock or blend of the aforementioned base stocks. Preferably, the lubricating oil is a Group II, Group III, Group IV, or Group V base stock, or a mixture thereof, such as a mixture of a Group I base stock and one or more a Group II, Group III, Group IV, or Group V base stock. Definitions for these base stocks and base oils are found in the American Petroleum Institute (API) publication Engine Oil Licensing and Certification System, ("ELOCS") Industry Services Department, Fourteenth Edition, December 1996, Addendum 1, December 1998.

The base stock, or base stock blend preferably has a saturate content of at least 65%, more preferably at least 75%, such as at least 85%. Preferably, the base stock or base stock blend is a Group III or higher base stock or mixture thereof, or a mixture of a Group II base stock and a Group III or higher base stock or mixture thereof. Most preferably, the base stock, or base stock blend, has a saturate content of greater than 90%. Preferably, the oil or oil blend will have a sulfur content of less than 1 mass %, preferably less than 0.6 mass %, most preferably less than 0.4 mass %, such as less than 0.3 mass % (as determined as indicated in API EOLCS). Group III base stock has been found to provide a wear credit relative to Group I base stock and, therefore, in one preferred embodiment, at least 30 mass %, preferably at least 50 mass %, more preferably at least 80 mass % of the lubricating oil is Group III base stock.

Preferably the volatility of the lubricating oil or oil blend, as measured by the Noack test (ASTM D5800), is less than or equal to 30 mass %, such as less than about 25 mass %, preferably less than or equal to 20 mass %, more preferably less than or equal to 15 mass %, most preferably less than or equal 13 mass %. Preferably, the viscosity index (VI) of the oil or oil blend is at least 85, preferably at least 100, most preferably from about 105 to 140 (ASTM D2270).

The Additive Composition of the First Aspect of the Invention

The first aspect of the invention is an additive composition for a hydrocarbonaceous liquid, the additive composition comprising the above ionic liquid, detergent and a carrier liquid and, optionally, further additives. It may be desirable to prepare the additive composition as a concentrate comprising the ionic liquid and detergent in a carrier liquid (being a diluent or solvent mutually compatible with both the ionic liquid and the hydrocarbonaceous liquid), to enable easier mixing or blending, whereby other additives can also be added simultaneously to the concentrate, and hence to the hydrocarbonaceous liquid, to form the hydrocarbonaceous liquid composition (such concentrates sometimes being referred to as additive packages). The ionic liquid may be added to an additive concentrate prior to the concentrate being combined with a hydrocarbonaceous liquid or may be added to a combination of additive concentrate and hydrocarbonaceous liquid. The ionic liquid may be added to an additive package prior to the package being combined with a hydrocarbonaceous liquid or may be added to a combination of additive package and hydrocarbonaceous liquid.

Where an additive concentrate is used, it may contain from 5 to 25 mass %, preferably 5 to 22 mass %, typically 10 to 20 mass % of the active ingredients, the remainder of the concentrate being solvent or diluent.

The additive composition (preferably in the form of a concentrate) may comprise further additives as a convenient way of incorporating multiple additives simultaneously into the hydrocarbonaceous liquid. Such further additives can have various properties and purposes depending on the needs of the service liquid in question.

Where the hydrocarbonaceous liquid is a lubricating oil or power transmission oil, particularly an engine lubricating oil, a variety of further additives may be incorporated to enhance other characteristics of the oil, which may comprise one or more dispersants; phosphorus-containing compounds; non-metal containing detergents; anti-wear agents; friction modifiers, viscosity modifiers; antioxidants; and other co-additives, provided they are different from essential ionic liquids and detergents hereinbefore described. These are discussed in more detail below.

A dispersant is an additive whose primary function is to hold oil-insoluble contaminations in suspension, thereby passivating them and reducing deposition on surfaces. For example, a dispersant maintains in suspension oil-insoluble substances that result from oxidation during use, thus preventing solids flocculation and precipitation or deposition on hardware parts.

Dispersants in this invention are "ashless", being non-metallic organic materials that form substantially no ash on combustion, in contrast to metal-containing and hence ash-forming materials. They comprise a long hydrocarbon chain with a polar head, the polarity being derived from inclusion of preferably an oxygen, phosphorus or nitrogen atom. The hydrocarbon is an oleophilic group that confers oil-solubility, having, for example 40 to 500 carbon atoms, such as 60 to 250 carbon atoms. Thus, ashless dispersants may comprise an oil-soluble polymeric backbone. The hydrocarbon portion of the dispersant may have a number average molecular weight (Mn) of from 800 to 5,000 g/mol, such as from 900 to 3000 g/mol.

A preferred class of olefin polymers is constituted by polybutenes, specifically polyisobutenes (PIB) or poly-n-butenes, such as may be prepared by polymerization of a C4 refinery stream.

Dispersants include, for example, derivatives of long chain hydrocarbon-substituted carboxylic acids, examples being derivatives of high molecular weight hydrocarbyl-substituted succinic acid. Typically, a hydrocarbon polymeric material, such as polyisobutylene, is reacted with an acylating group (such as maleic acid or anhydride) to form a hydrocarbon-substituted succinic acid (succinate). A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025), fluorinated or oxylated. For example, boration may be accomplished by treating an acyl nitrogen-containing dispersant with a boron compound selected from boron oxide, boron halides, boron acids and esters of boron acids.

Preferably, the dispersant, if present, is a succinimide-dispersant derived from a polyisobutene of number average molecular weight in the range of 800 to 5000 g/mol, such as 1000 to 3000 g/mol, preferably 1500 to 2500 g/mol, and of moderate functionality. The succinimide is preferably derived from highly reactive polyisobutene.

Another example of dispersant type that may be used is a linked aromatic compound such as described in EP-A-2 090 642.

Combinations of borated and non-borated succinimide are useful herein.

Combinations of one or more (such as two or more) higher Mn succinimides (Mn of 1500 g/mol or more, such as 2000 g/mol or more) and one or more (such as two or more) lower Mn (Mn less than 1500 g/mol, such as less than 1200 g/mol) succinimides are useful herein, where the combinations may optionally contain one, two, three or more borated succinimides.

Suitable phosphorus-containing compounds include dihydrocarbyl dithiophosphate metal salts, which are frequently used as anti-wear agents and antioxidants. The metal is preferably zinc, but may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with P2S5, and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil-soluble salts of dihydrocarbyl dithiophosphoric acids and may be represented by the following formula:

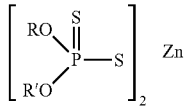

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups in this context are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be 5 or greater. The zinc dihydrocarbyl dithiophosphate (ZDDP) can therefore comprise zinc dialkyl dithiophosphates. Additive concentrates of the present invention for lubricants may have a phosphorus content of 100 to 1500 ppm P, such as 200 to 1200 ppm P, such as 600 to 900 ppm P, such as of no greater than about 0.08 mass % (800 ppm) as determined by ASTM D5185. Preferably, in the practice of the present invention, ZDDP is used in an amount close or equal to the maximum amount allowed, preferably in an amount that provides a phosphorus content within 100 ppm of the maximum allowable amount of phosphorus. Thus, resulting lubricating oil compositions preferably contain ZDDP or other zinc-phosphorus compounds, in an amount introducing from 0.01 to 0.08 mass % of phosphorus, such as from 0.04 to 0.08 mass % of phosphorus, preferably, from 0.05 to 0.08 mass % of phosphorus, based on the total mass of the lubricating oil composition.

Additional additives may also be incorporated into the additive concentrates of the invention to enable particular performance requirements to be met. Examples of such additives which may be included in lubricating oil compositions of the present invention are friction modifiers, viscosity modifiers, metal rust inhibitors, viscosity index improvers, corrosion inhibitors, oxidation inhibitors, anti-foaming agents, anti-wear agents and pour point depressants.

Friction modifiers (and, also in engine lubricants, fuel economy agents) that are compatible with the other ingredients of hydrocarbonaceous liquid may be included in the lubricating oil composition. Examples of such materials include glyceryl monoesters of higher fatty acids, for example, glyceryl mono-oleate; esters of long chain polycarboxylic acids with diols, for example, the butane diol ester of a dimerized unsaturated fatty acid; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and anti-wear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, MoOCl4, MoO2Br2, Mo2O3Cl6, molybdenum trioxide or similar acidic molybdenum compounds.

Among the molybdenum compounds useful in the compositions of this invention are organo-molybdenum compounds of the formulae:

$Mo(R''OCS_2)_4$ and $Mo(R''SCS_2)_4$ wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful as further additives in this invention are trinuclear molybdenum compounds, especially those of the formula Mo3SkAnDz and mixtures thereof wherein the A are independently selected ligands having organo groups with a sufficient number of carbon atoms to render the compound soluble or dispersible in the oil, n is from 1 to 4, k varies from 4 to 7, D is selected from the group of neutral electron donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Where the additive is intended for a hydrocarbonaceous liquid which is a lubricating oil, it preferably contains at least 10 ppm, at least 30 ppm, at least 40 ppm and more preferably at least 50 ppm molybdenum. Suitably, such lubricating oil compositions contain no more than 1000 ppm, no more than 750 ppm or no more than 500 ppm of molybdenum. Lubricating oil compositions useful in the present invention preferably contain from 10 to 1000, such as 30 to 750 or 40 to 500, ppm of molybdenum (measured as atoms of molybdenum).

The viscosity index of the hydrocarbonaceous liquid, and especially lubricating oils, may be increased or improved by incorporating in the additive composition certain polymeric materials that function as viscosity modifiers (VM) or viscosity index improvers (VII). Generally, polymeric materials useful as viscosity modifiers are those having number average molecular weights (Mn) of from 5,000 to 250,000, preferably from 15,000 to 200,000, more preferably from 20,000 to 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

Pour point depressants (PPDs) lower the lowest temperature at which the bulk liquid flows and may also be present in the additive, especially in lubricating oils. PPDs can be grafted with grafting materials such as, for example, maleic anhydride, and the grafted material can be reacted with, for example, amines, amides, nitrogen-containing heterocyclic compounds or alcohol, to form multifunctional additives.

In the present invention it may be advantageous to include a co-additive which maintains the stability of the viscosity of the blend. Thus, although polar group-containing additives achieve a suitably low viscosity in the pre-blending stage, it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When the additive of the first aspect contains one or more of the above-mentioned further additives in addition to the ionic liquid, each further additive is typically blended into the bulk liquid in an amount that enables the additive to provide its desired function.

The Hydrocarbonaceous Liquid Composition of the Second Aspect of the Invention

The second aspect of the invention is a hydrocarbonaceous liquid composition comprising a major amount of hydrocarbonaceous liquid and minor amounts of an ionic liquid and a detergent additive, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and the detergent additive comprising, as active ingredient, one or more neutral or overbased hydrocarbyl-substituted metal salts.

Such a hydrocarbonaceous liquid composition is formed from the ionic liquids, detergents and hydrocarbonaceous liquids described hereinbefore, and is preferably obtained or obtainable by the method or use of the third, fourth or fifth aspects of the invention below. It may additionally contain the further additives described under the first aspect of the invention.

Representative effective amounts of such further additives, when intended for use in hydrocarbonaceous liquids which are crankcase lubricants, are listed below. All the values listed (with the exception of detergent values since the detergents are used in the form of colloidal dispersants in an oil) are stated as mass percent active ingredient (A.I.). These amounts of further additives are used in combination with the ionic liquid and detergent hereinbefore described.

| ADDITIVE | MASS % (Broad) | MASS % (Preferred) |
|---|---|---|
| Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2.5 |
| Pour Point Depressant | 0.01-5 | 0.01-1.5 |
| Anti-foaming Agent | 0-5 | 0.001-0.15 |
| Friction Modifier | 0-5 | 0-1.5 |
| Viscosity Modifier | 0.01-10 | 0.25-3 |
| Ionic Liquid | 0.1 to 5.0 | 0.1 to 3 |
| Hydrocarbonaceous Liquid (basestock) | Balance | Balance |

The ionic liquid and detergent and other desired additives may be added to the hydrocarbonaceous liquid by physical mixing or blending techniques known in the art. It may be desirable, although not essential, to prepare one or more additive compositions of the first aspect comprising the ionic liquid and detergent in a carrier liquid (being a diluent or solvent mutually compatible with both the ionic liquid and the hydrocarbonaceous liquid), ideally in concentrate form (such concentrates sometimes being referred to as additive packages), to enable easier mixing or blending, whereby other additives can also be added simultaneously to the concentrate, and hence to the hydrocarbonaceous liquid, to form the composition of the second aspect.

The method of the third aspect of the invention

The third aspect of the invention deploys the above ionic liquid and detergent in combination in a method of limiting the chemical degradation of a hydrocarbonaceous liquid in service at bulk liquid temperatures of between 60 and 180° C., the degradation being initiated by nitration of the liquid resulting from contamination with nitrogen dioxide in service. The method comprises the steps of:

preparing, or obtaining a freshly prepared, hydrocarbonaceous liquid suitable for service at bulk liquid temperatures of between 60 and 180° C. and being free of aged components and nitrogen dioxide contamination;

adding the above defined ionic liquid and detergent additive to said hydrocarbonaceous liquid, prior to service at bulk liquid temperatures of between 60 and 180° C., wherein the ionic liquid and detergent active ingredient are added in amounts that are co-operatively effective to thereafter inhibit the nitration of the hydrocarbonaceous liquid in service at bulk liquid temperatures of between 60 and 180° C., in the presence of nitrogen dioxide contamination; and putting said hydrocarbonaceous liquid into service, wherein the ionic liquid and detergent additive thereby limit the resulting chemical degradation of the liquid.

In this method, the combined effectiveness of the ionic liquid and detergent in inhibiting the nitration reactions initiated by the nitrogen dioxide on hydrocarbonaceous compounds at elevated temperatures leads to the slower onset of degradation in the bulk liquid by this chemical pathway, prolonging its service life. The ionic liquid firstly acts through inhibiting the proton abstraction by nitrogen dioxide which initiates nitration of the bulk liquid, slowing the initial formation of free radicals which feeds other chemical reactions further along the pathway and delaying the onset of significant degradation. The ionic liquid and detergent further act later in the pathway by inhibiting the formation of hydrocarbonaceous nitrate esters from the reaction of nitrogen dioxide with subsequent RO radicals, resulting in a smaller accumulation of these reactive compounds within the bulk liquid. As a result, the bulk liquid is exposed to lower concentrations of released RO radicals at elevated temperatures, especially those service temperatures rising (continuously or periodically) above 110° C., where the rate of dissociation of these nitrate esters greatly increases and results in escalating, more severe degradation of the bulk liquid.

The amounts of ionic liquid and detergent active ingredient that are effective to co-operatively inhibit nitration in the method of the invention can be arrived at by routine testing under conditions reproducing or simulating nitrogen dioxide contamination at the elevated service temperatures experienced in the system in question.

In a preferred aspect of the method, the chemical degradation inhibited by the combination of ionic liquid and detergent is that resulting from the decomposition of hydrocarbonaceous nitrate esters formed in service by the nitration of the hydrocarbonaceous liquid by nitrogen dioxide at bulk liquid temperatures of between 60 and 180° C., wherein the ionic liquid and detergent active ingredient are added in amounts determined to inhibit the formation of hydrocarbonaceous nitrate esters in that service. In this way, the accumulation of a reservoir of reactive hydrocarbonaceous nitrate esters at elevated service temperatures is directly inhibited, and degradation is better limited.

In a more preferred aspect of the method, the chemical degradation inhibited by the combination of ionic liquid and detergent is that resulting from the decomposition of the hydrocarbonaceous nitrate esters due to the hydrocarbonaceous liquid being periodically or continuously subjected in service to bulk liquid temperatures of between 110 and 160° C., wherein the ionic liquid and detergent active ingredient are added in amounts determined to inhibit the formation of hydrocarbonaceous nitrate esters in that service. In this way, the more rapid, severe degradation that occurs in service at higher elevated temperatures is directly inhibited.

In these embodiments of the invention, the level of nitrate ester formation in the bulk liquid can be determined spectroscopically by observing the growth in the infra-red peak height associated with nitrate ester over time in the bulk liquid under suitable test conditions. This spectroscopic approach allows the determination of the amounts of ionic liquid and detergent required to inhibit the formation of nitrate esters in the bulk liquid. The inhibition of hydrocarbonaceous nitrate ester formation in service is determined by the observance of a lower nitrate ester peak height in the bulk liquid in the combined presence of the ionic liquid and detergent active ingredient, as compared with the nitrate ester peaks observed with ionic liquid or detergent active ingredient alone, as measured by infrared spectroscopy according to DIN 51 453 or ASTM D8048-20 (in the event of conflict between DIN 51 453 and ASTM D8048-20, DIN 51 453 shall control), under like conditions of service and nitrogen dioxide contamination. According to the DIN method, the height of a single infrared absorption frequency at 1630 cm-1 is measured above a straight-line baseline defined by the absorption at 1615 and 1645 cm-1. The higher the peak height, the more nitrate ester is present in the bulk liquid. Measurement of a series of samples taken over time also allows the change in peak height to be followed as the level of nitrate ester in the service liquid changes over time. According to the ASTM D8048-20 Standard test method, oxidation and nitration peak heights are measured by first subtracting the fresh oil infrared spectrum. The baseline is defined by absorption between 1950 cm-1 and 1850 cm-1 with highest peak in the range 1740 cm-1 to 1700 cm-1 used for oxidation and 1640 cm-1 to 1620 cm-1 for nitration.

Determining the amount of reduction or limitation of nitrate ester formation in a lubricating oil composition is determined by the observance of a lower (by at least 10%, such by at least 20%, such as by at least 30%, such as by at least 40%, such as by at least 50%, such as by 100%) nitrate ester peak height in the presence of the lubricating oil composition containing ionic liquid (as compared to the nitrate ester peak of the same lubricating oil composition where the ionic liquid is replaced with an ionic liquid having the same cation, but hexanoate as the anion in the same proportions), as measured by infrared spectroscopy according to DIN 51 453 or ASTM D8048-20, under like conditions of service and nitrogen dioxide contamination, provided that in the event of conflicting results between DIN 51 453 and ASTM D8048-20, DIN 51 453 shall control.

In normal circumstances, however, the amount of ionic liquid added to thereafter inhibit the nitration of the hydrocarbonaceous liquid in service at bulk liquid temperatures of 60° C. or more, such as 110° C. or more, such as between 60 and 180° C. (such as from 60 to 180° C., such as 60 to 160° C., such as 110 to 160° C., such as 130 to 160° C.), in the presence of nitrogen dioxide contamination, is in the range of 0.1 to 5.0% by weight, per weight of hydrocarbonaceous liquid; and preferably 0.5 to 4.0% by weight, per weight of hydrocarbonaceous liquid. More preferably, the ionic liquid is added in an amount in the range of 1.0 to 3.5% by weight, per weight of hydrocarbonaceous liquid; and most preferably in the range of 1.0 to 3.0% by weight, per weight of hydrocarbonaceous liquid.

Also in normal circumstances, the amount of detergent added to thereafter inhibit the nitration of the hydrocarbonaceous liquid in service at bulk liquid temperatures of between 60 and 180° C., in the presence of nitrogen dioxide contamination, is in the range of 0.2 to 5.0% by weight of active ingredient, per weight of hydrocarbonaceous liquid; and preferably 0.5 to 4.0% by weight of active ingredient, per weight of hydrocarbonaceous liquid. More preferably, the detergent is added in an amount in the range of 1.0 to 3.0% by weight of active ingredient, per weight of hydrocarbonaceous liquid; and most preferably in the range of 1.5 to 2.5% by weight of active ingredient, per weight of hydrocarbonaceous liquid.

The hydrocarbonaceous liquid deployed in the method of the invention is a liquid suitable for service at bulk liquid temperatures of 60° C. or more, such as 110° C. or more, such as between 60 and 180° C. (such as from 60 to 180° C., such as 60 to 160° C., such as 110 to 160° C., such as 130 to 160° C.) and being free of aged components and nitrogen dioxide contamination prior to service (or substantially free, e.g., less than 5 ppm, of aged components and less than 10 ppm, of nitrogen dioxide contamination). Such service liquids are used in a variety of applications, including industrial and automotive oils and power transmission fluids, such as engine lubricating oils.

In the method the hydrocarbonaceous liquid is preferably a lubricating oil for a mechanical device. More preferably in the method, the hydrocarbonaceous liquid is a crankcase lubricating oil for an internal combustion engine, and is subjected in service to nitrogen dioxide contamination originating from exhaust gas, which gas becomes entrained in the lubricant via the effects of blow-by gas into the crankcase and direct contact on the engine cylinder walls. Most preferably, this crankcase lubricating oil is one periodically or continuously subjected to bulk liquid temperatures in the crankcase of between 110 and 160° C.

It is important to obtaining the benefits of the method that, prior to service, the hydrocarbonaceous liquid be initially free of nitrogen dioxide contamination and also be initially free of the aged liquid components that arise during service from oxidative or other chemical breakdown, in order not to seed the liquid with significant quantities of reactive chemical species that can offer an alternative or complementary degradative pathway to nitrogen-dioxide initiated nitration. Thus, preferably the hydrocarbonaceous liquid should be freshly prepared and not have been in prior service; and prior to being placed into the service environment should not be pre-mixed or diluted prior to service with a proportion of aged liquid that has been in prior use or exposed to nitrogen dioxide contamination.

Alternately, prior to service, the hydrocarbonaceous liquid may be initially substantially free of nitrogen dioxide contamination (10 ppm or less, such as 5 ppm or less, such as 0 ppm) and also substantially free of the aged liquid components (10 ppm or less, such as 5 ppm or less, such as 0 ppm) that arise during service from oxidative or other chemical breakdown (or substantially free, e.g., less than 0.0001-mass % of aged components and less than 10 ppm, of nitrogen dioxide contamination).

It is also important that the ionic liquid is added prior to service and the resulting onset of elevated temperatures and nitrogen dioxide contamination, to maximise its nitration-inhibiting effect and not allow nitrogen dioxide concentration in the bulk liquid to build unhindered.

In the method, the ionic liquid and detergent can be added to the hydrocarbonaceous liquid by physical mixing or blending techniques known in the art. It may be desirable, although not essential, to prepare one or more additive compositions of the first aspect comprising the ionic liquid and detergent in a carrier liquid (being a diluent or solvent mutually compatible with both the ionic liquid and the hydrocarbonaceous liquid), ideally in concentrate form, to enable easier mixing or blending, whereby other additives can also be added simultaneously to the concentrate, and hence to the oil, to form the lubricating oil composition (such concentrates sometimes being referred to as additive packages).

Where an additive concentrate is used, it may contain from 5 to 25 mass %, preferably 5 to 22 mass %, typically 10 to 20 mass % of the ionic liquid, the remainder of the concentrate being solvent or diluent.

The advantageous nature of the method in limiting the chemical degradation due to nitration is demonstrated hereinafter in the worked examples of the invention.

The Use of the Fourth Aspect of the Invention

The fourth aspect of the invention provides the co-operative use of the ionic liquid and detergent additive hereinbefore described to limit the chemical degradation of a hydrocarbonaceous liquid in service at bulk liquid temperatures of between 60 and 180° C., the degradation being initiated by nitration of the hydrocarbonaceous liquid resulting from contamination with nitrogen dioxide in service, wherein the ionic liquid and detergent are added to a hydrocarbonaceous liquid free of aged components and nitrogen dioxide contamination prior to service, and wherein the ionic liquid and detergent thereafter inhibit the nitration of the hydrocarbonaceous liquid in service at bulk liquid temperatures of between 60 and 180° C. in the presence of nitrogen dioxide contamination.

The fourth aspect of the invention uses the ionic liquid and detergent to inhibit the nitration of a hydrocarbonaceous liquid initiated by contamination with nitrogen dioxide in service at bulk liquid temperatures of between 60 and 180° C. In this use, the ionic liquid and detergent act as hereinbefore described, and work together to limit the chemical degradation of the bulk hydrocarbonaceous liquid resulting from nitrogen dioxide contamination.

The ionic liquids, detergents and hydrocarbonaceous liquids that are suitable and preferred in this use aspect of the invention are those already described in this specification.

The amount of ionic liquid and detergent that is co-operatively effective to inhibit nitration in this use of the invention can be arrived at by routine testing under conditions reproducing or simulating nitrogen dioxide contamination at the elevated service temperatures experienced in the system in question.

In a preferred aspect of this use, the chemical degradation inhibited by the ionic liquid and detergent is that resulting from the decomposition of hydrocarbonaceous nitrate esters formed in service by the nitration of the hydrocarbonaceous liquid by nitrogen dioxide at bulk liquid temperatures of between 60 and 180° C., and the ionic liquid and detergent inhibit the formation of hydrocarbonaceous nitrate esters in that service. In this way, the accumulation of a reservoir of reactive hydrocarbonaceous nitrate esters at elevated service temperatures is directly inhibited, and degradation is better limited.

In a more preferred aspect of this use, the chemical degradation inhibited by the ionic liquid and detergent is that resulting from the decomposition of the hydrocarbonaceous nitrate esters due to the hydrocarbonaceous liquid being periodically or continuously subjected in service to bulk liquid temperatures of between 110 and 160° C., and the ionic liquid and detergent inhibit the formation of hydrocarbonaceous nitrate esters in that service. In this way, the more rapid, severe degradation that occurs in service at higher elevated temperatures is directly inhibited.

In these use embodiments of the invention, the level of nitrate ester formation in the bulk liquid can be determined spectroscopically by observing the growth in the infra-red peak height associated with nitrate ester over time in the bulk liquid under suitable test conditions. This spectroscopic approach allows the observation of the effect of ionic liquid and detergent to inhibit the formation of nitrate esters in the bulk liquid. The inhibition of hydrocarbonaceous nitrate ester formation in service is determined by the observance of a lower nitrate ester peak height in the bulk liquid in the combined presence of the ionic liquid and detergent, as measured by infrared spectroscopy according to DIN 51 453 or ASTM D8048-20, as compared with the nitrate ester peaks observed with ionic liquid or detergent active ingredient alone, under like conditions of service and nitrogen dioxide contamination. According to this DIN method, the height of a single infrared absorption frequency at 1630 cm-1 is measured above a straight-line baseline defined by the absorption at 1615 and 1645 cm-1. The higher the peak height, the more nitrate ester is present in the bulk liquid. Measurement of a series of samples taken over time also allows the change in peak height to be followed as the level of nitrate ester in the service liquid changes over time. According to the ASTM D8048-20 Standard test method, oxidation and nitration peak heights are measured by first subtracting the fresh oil infrared spectrum. The baseline is defined by absorption between 1950 cm-1 and 1850 cm-1, with the highest peak in the range of 1740 cm-1 to 1700 cm-1 used for oxidation and 1640 cm-1 to 1620 cm-1 for nitration.

In normal circumstances, however, the amount of ionic liquid used to inhibit the nitration of the hydrocarbonaceous liquid in service at bulk liquid temperatures of between 60 and 180° C., in the presence of nitrogen dioxide contamination, is in the range of 0.1-5.0% by weight, per weight of hydrocarbonaceous liquid; and preferably 0.5 to 4.0% by weight, per weight of hydrocarbonaceous liquid. More preferably, the ionic liquid is used in an amount in the range of 1.0 to 3.5% by weight, per weight of hydrocarbonaceous liquid; and most preferably in the range of 1.0 to 3.0% by weight, per weight of hydrocarbonaceous liquid.

Also in normal circumstances, the amount of detergent added to thereafter inhibit the nitration of the hydrocarbonaceous liquid in service at bulk liquid temperatures of between 60 and 180° C., in the presence of nitrogen dioxide contamination, is in the range of 0.2 to 5.0% by weight of active ingredient, per weight of hydrocarbonaceous liquid; and preferably 0.5 to 4.0% by weight of active ingredient, per weight of hydrocarbonaceous liquid. More preferably, the detergent is added in an amount in the range of 1.0 to 3.0% by weight of active ingredient, per weight of hydrocarbonaceous liquid; and most preferably in the range of 1.5 to 2.5% by weight of active ingredient, per weight of hydrocarbonaceous liquid.

The Use of the Fifth Aspect of the Invention

The fifth aspect provides the use of a detergent additive comprising, as the active ingredient, one or more hydrocarbyl-substituted neutral or overbased metal salts, to increase the efficacy of an ionic liquid additive for inhibiting the nitration of a hydrocarbonaceous liquid in service at bulk liquid temperatures of between 60 and 180° C. and resulting from contamination with nitrogen dioxide in service, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

wherein the detergent additive is added to the hydrocarbonaceous liquid containing the ionic liquid additive prior to service at bulk liquid temperatures of between 60 and 180° C. and exposure to nitrogen dioxide contamination.

The ionic liquids, detergents and hydrocarbonaceous liquids that are suitable and preferred in all use aspects of the invention are those already described in this specification.

The amount of detergent that is used to increase the efficacy of the ionic liquid to inhibit nitration in this use of the invention can be arrived at by routine testing under conditions reproducing or simulating nitrogen dioxide contamination at the elevated service temperatures experienced in the system in question.

In a preferred aspect of this use, the chemical degradation inhibited by the ionic liquid and enhanced by the detergent is that resulting from the decomposition of hydrocarbonaceous nitrate esters formed in service by the nitration of the hydrocarbonaceous liquid by nitrogen dioxide at bulk liquid temperatures of between 60 and 180° C., where the ionic liquid and detergent inhibit the formation of hydrocarbonaceous nitrate esters in that service. In this way, the accumulation of a reservoir of reactive hydrocarbonaceous nitrate esters at elevated service temperatures is directly inhibited, and degradation is better limited.

In a more preferred aspect of this use, the chemical degradation inhibited by the ionic liquid and enhanced by the detergent is that resulting from the decomposition of the hydrocarbonaceous nitrate esters due to the hydrocarbonaceous liquid being periodically or continuously subjected in service to bulk liquid temperatures of between 110 and 160° C., and the ionic liquid and detergent inhibit the formation of hydrocarbonaceous nitrate esters in that service. In this way, the more rapid, severe degradation that occurs in service at higher elevated temperatures is directly inhibited.

In this use embodiment of the invention, as in the fourth aspect, the level of nitrate ester formation in the bulk liquid can be determined spectroscopically by observing the growth in the infra-red peak height associated with nitrate ester over time in the bulk liquid under suitable test conditions. This spectroscopic approach allows the observation of the increase in efficacy of the ionic liquid to inhibit the formation of nitrate esters in the bulk liquid, in the presence of the detergent. The inhibition of hydrocarbonaceous nitrate ester formation in service is determined by the observance of a lower nitrate ester peak height in the bulk liquid in the presence of the ionic liquid and detergent, as measured by infrared spectroscopy according to DIN 51 453 or ASTM D8048-20, as compared with the nitrate ester peak observed with the same quantity of ionic liquid active ingredient alone, under like conditions of service and nitrogen dioxide contamination. According to this DIN method, the height of a single infrared absorption frequency at 1630 cm-1 is measured above a straight-line baseline which is defined by the absorption at 1615 and 1645 cm-1. The higher the peak height, the more nitrate ester is present in the bulk liquid. Measurement of a series of samples taken over time also allows the change in peak height to be followed as the level of nitrate ester in the service liquid changes over time. According to the ASTM D8048-20 Standard test method, oxidation and nitration peak heights are measured by first subtracting the fresh oil infrared spectrum. The baseline is defined by absorption between 1950 cm-1 and 1850 cm-1 with highest peak in the range 1740 cm-1 to 1700 cm-1 used for oxidation and 1640 cm-1 to 1620 cm-1 for nitration.

In normal circumstances, however, the amount of ionic liquid used to inhibit the nitration of the hydrocarbonaceous liquid in service at bulk liquid temperatures of between 60 and 180° C., in the presence of nitrogen dioxide contamination, is in the range of 0.1-5.0% by weight, per weight of hydrocarbonaceous liquid; and preferably 0.5 to 4.0% by weight, per weight of hydrocarbonaceous liquid. More preferably, the ionic liquid is used in an amount in the range of 1.0 to 3.5% by weight, per weight of hydrocarbonaceous liquid; and most preferably in the range of 1.0 to 3.0% by weight, per weight of hydrocarbonaceous liquid.

Also in normal circumstances, the amount of detergent added to increase the efficacy of the ionic liquid to inhibit nitration of the hydrocarbonaceous liquid in service at bulk liquid temperatures of between 60 and 180° C., in the presence of nitrogen dioxide contamination, is in the range of 0.2 to 5.0% by weight of active ingredient, per weight of hydrocarbonaceous liquid; and preferably 0.5 to 4.0% by weight of active ingredient, per weight of hydrocarbonaceous liquid. More preferably, the detergent is added in an amount in the range 1.0 to 3.0% by weight of active ingredient, per weight of hydrocarbonaceous liquid; and most preferably in the range of 1.5 to 2.5% by weight of active ingredient, per weight of hydrocarbonaceous liquid.

Most preferably, the method of the third aspect of the invention, and uses of all the other aspects of the invention, are directed to limiting the degradation of hydrocarbonaceous liquids that are engine lubricating oils. These oils are exposed to nitrogen dioxide contamination in service, due to the presence of exhaust gas blow-by from the combustion chamber past the piston rings into the crankcase. Such oils, also termed crankcase oils, operate at bulk liquid temperatures wherein the nitration pathway to oil degradation is significant, especially when the oil is fresh and aged oil components have not appreciably formed by other mechanisms. Hotter-running engines are particularly susceptible to such degradation, especially those experiencing temperature regimes or cycles in the bulk crankcase oil of between 110 and 160° C., and in particular between 130 and 160° C.

Preferred in the above method and all uses of the invention are ionic liquids in which one or more anions (ii), and more preferably all anions (ii), comprise a hydrocarbyl group being an aromatic ring, bearing at least two substituent functional groups containing heteroatoms, these functional groups being conjugated with the aromatic ring, and this conjugated system bearing the anionic (negative) charge. It is believed that anions of this preferred configuration have a particular affinity for nitrogen dioxide, and are able to bind to it in such a way that its reactivity towards hydrocarbonaceous compounds is significantly reduced.

The aromatic ring is composed of carbon and optionally one or more heteroatoms such as nitrogen or oxygen. However, it is preferred that each anion (ii) of the ionic liquid is nitrogen-free. Such ionic liquids have been found to be more advantageous in the present invention, and cannot make a contribution to nitrogen dioxide formation in environments where a proportion of the ionic liquid will be consumed by combustion, for example in engine lubricant environments.

In a first advantageous form of this preferred embodiment of the anion, the aromatic ring of each anion (ii) bears two substituent functional groups containing heteroatoms. More preferably, the aromatic ring of each anion (ii) of the ionic liquid bears a carboxylate group and a further heteroatom-containing functional group. It is more preferred that both the heteroatom(s) in both these functional groups consist of oxygen atoms. These functional groups are more preferably positioned on adjacent ring carbon atoms in 'ortho' configuration to each other on the aromatic ring.

In this embodiment of the anion, it is highly preferred that each anion (ii) is a disubstituted benzene ring bearing a carboxylate group and a second hetero-atom-containing functional group containing only oxygen as the heteroatom, these two groups preferably being positioned in 'ortho' configuration to each other on the aromatic ring. It is preferred that the second functional group is a hydroxyl group, giving rise to a hydroxybenzoate anion (ii). Most preferably the one or more anions (ii) of the ionic liquid are one or more salicylate anions, i.e., anions formed from the deprotonation of salicylic acid.

In the second, more advantageous form of the preferred embodiment of the anion, the aromatic ring itself of each anion (ii) of the ionic liquid additionally bears one or more hydrocarbyl substituents. These substituents provide additional hydrophobicity to the ionic liquid, enabling it to mix more readily with hydrocarbonaceous bulk liquid.

The additional hydrocarbyl substituent(s) on the aromatic ring of this second embodiment of the anion are as previously defined. Preferably, these substituent(s) are alkyl substituents. Suitable alkyl groups include those straight- or branched-chain alkyl groups containing 6 or more carbon atoms, preferably 6 to 28 carbon atoms, more preferably 6 to 14 carbon atoms. Particularly suitable alkyl substituents include hexyl, octyl, decyl, dodecyl, tetradecyl, hexadecyl and octadecyl groups, and especially where n-alkyl groups.

The aromatic ring of this second embodiment of anion (ii) may bear a single alkyl substituent or multiple alkyl substituents. The consequent ionic liquid may be composed of a mixture of anions (ii) differing in their number and/or position of alkyl substituents, which are preferably selected from the above-specified alkyl substituents. Preferably at least one of the alkyl substituents contains at least 10 carbon atoms and is selected from the above examples. More preferably, the aromatic ring of each anion (ii) of the ionic liquid bears one or more straight- or branched-chain alkyl substituents having more than 10 carbon atoms.

In the second, more preferred embodiment of the anion, one or more anions (ii) are preferably hydrocarbyl-substituted hydroxybenzoates of the structure:

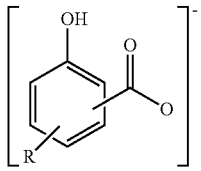

wherein R is a linear or branched hydrocarbyl group, and more preferably an alkyl group as defined above, including straight- or branched-chain alkyl groups. There may be more than one R group attached to the benzene ring. The carboxylate group and hydroxyl group are conjugated to the aromatic ring, and this system bears the negative (anionic) charge. The carboxylate group can be in the ortho, meta or para position with respect to the hydroxyl group; the ortho position is preferred. The R group can be in the ortho, meta or para position with respect to the hydroxyl group.

In the second embodiment of the anion, one or more anions (ii) of the ionic liquid are most preferably one or more alkyl-substituted salicylate anions, wherein the alkyl substituent(s) of each anion are independently selected from alkyl groups containing from 12 to 24 carbon atoms; and more preferably from dodecyl, tetradecyl, hexadecyl and octadecyl groups.

Such hydroxybenzoate and salicylate anions are typically prepared via the carboxylation, by the Kolbe-Schmitt process, of phenoxides, and in that case, will generally be obtained (normally in a diluent) in admixture with uncarboxylated phenol.

Also preferred in this method and uses are detergents wherein the active ingredient is, or comprises, one or more neutral or overbased metal salts of one or more hydrocarbyl-substituted carboxylic acids, and more preferably one or more neutral or overbased metal salts of one or more hydroxybenzoic acids.

Such carboxylate detergents can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain hetero atoms, such as nitrogen and oxygen. Preferably, the moiety contains only carbon atoms; more preferably the moiety contains six or more carbon atoms; for example, benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

In this aspect of the invention, it is particularly preferred that the detergent active ingredient is one or more alkaline earth metal salts of alkyl-substituted salicylic acids, and most preferably one or more magnesium salts of alkyl-substituted salicylic acids. In both such embodiments, the alkyl substituent(s) of each salicylic acid salt constituting the detergent active ingredient are most preferably independently selected from alkyl groups containing from 9 to 30, especially 14 to 20, carbon atoms.

Detergents comprising magnesium salts are preferred in the practice of the invention. In this aspect of the invention, the magnesium detergent may be the sole metal-containing detergent, in which case 100% of the metal introduced into the lubricating oil composition by detergent will be magnesium. Where overbased or neutral detergents based on metals other than magnesium are employed, preferably at least about 30 mass %, more preferably at least about 40 mass %, particularly at least about 50 mass % of the total amount of metal introduced into the lubricating oil composition by detergent will be magnesium.

This invention further relates to:

1. An additive composition for hydrocarbonaceous liquids, the additive composition comprising an ionic liquid and a detergent additive, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and the detergent additive comprising, as active ingredient, one or more neutral or overbased hydrocarbyl-substituted metal salts; the additive composition further comprising a carrier liquid or diluent.

2. A hydrocarbonaceous liquid composition comprising a major amount of hydrocarbonaceous liquid and minor amounts of an ionic liquid and a detergent additive, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and the detergent additive comprising, as active ingredient, one or more neutral or overbased hydrocarbyl-substituted metal salts.

3. The composition of paragraph 1 or paragraph 2, wherein each cation (i) of the ionic liquid contains nitrogen.

4. The composition of paragraph 3, wherein each cation (i) consists of a substituted ammonium cation, or an alicyclic or aromatic ring system incorporating nitrogen and bearing the cationic charge.

5. The composition of paragraph 3 or paragraph 4, wherein each cation (i) is a tetra-substituted ammonium cation.

6. The composition of paragraph 5, wherein each cation (i) of the ionic liquid is nitrogen-free.

7. The composition of paragraph 6, wherein each cation (i) of the ionic liquid consists of a tetra-hydrocarbyl substituted central atom or ring system bearing the cationic charge.

8. The composition of paragraph 7, wherein each cation (i) of the ionic liquid is a tetra-alkyl substituted phosphonium cation.

9. The composition of any preceding paragraph 1 to 8, wherein each anion (ii) of the ionic liquid is nitrogen-free.

10. The composition of any preceding paragraph 1 to 9, wherein each anion (ii) of the ionic liquid comprises a carboxylate functional group.

11. The composition of paragraph 10, wherein each anion (ii) of the ionic liquid is a hexanoate anion.

12. The composition of paragraph 10, wherein each anion (ii) of the ionic liquid comprises a carboxylate group and a further heteroatom-containing functional group.

13. The composition of paragraph 12, wherein each anion (ii) of the ionic liquid comprises a hydrocarbyl group being an aromatic ring, which ring bears the carboxylate group and a further heteroatom-containing functional group, these functional groups being conjugated with the aromatic ring and this conjugated system bearing the anionic charge.

14. The composition of paragraph 13, wherein the one or more anions (ii) of the ionic liquid are one or more salicylate anions.

15. The composition of paragraph 13, wherein the aromatic ring of each anion (ii) of the ionic liquid additionally bears one or more straight- or branched-chain alkyl substituents.

16. The composition of paragraph 15, wherein the one or more anions (ii) of the ionic liquid are one or more alkyl-substituted salicylate anions, and wherein the alkyl substituent(s) of each anion is independently selected from alkyl groups containing from 12 to 24 carbon atoms.

17. The composition of paragraph 11, 14, or 16, wherein each cation (i) of the ionic liquid is a trihexyltetradecylphosphonium cation.

18. The composition of any preceding paragraph 1 to 17, wherein the detergent active ingredient is, or comprises, one or more neutral or overbased metal salts of one or more hydrocarbyl-substituted aromatic acids or phenols.

19. The composition of paragraph 18, wherein the detergent active ingredient is, or comprises, one more neutral or overbased metal salts of one or more hydrocarbyl-substituted benzene sulfonic acids.

20. The composition of paragraph 18, wherein the detergent active ingredient is, or comprises, one or more neutral or overbased metal salts of one or more hydrocarbyl-substituted hydroxybenzoic acids.

21. The composition of paragraph 20, wherein the detergent active ingredient is one or more alkaline earth metal salts of alkyl-substituted salicylic acids.

22. The composition of paragraph 21, wherein the detergent active ingredient is one or more magnesium salts of alkyl-substituted salicylic acids.

23. The composition of paragraph 21 or paragraph 22, wherein the alkyl substituent(s) of each salicylic acid salt constituting the detergent active ingredient are independently selected from alkyl groups containing from 9 to 30 carbon atoms.

24. The composition of any preceding paragraph, additionally comprising an ashless dispersant additive, and preferably a phosphorus-containing compound.

25. The composition of paragraph 2, or any of paragraphs 3 to 24 when read with paragraph 2, wherein the hydrocarbonaceous liquid is a lubricating oil, more preferably a crankcase lubricating oil for an internal combustion engine.

26. A method of limiting the chemical degradation of a hydrocarbonaceous liquid in service at bulk liquid temperatures of between 60 and 180° C., the degradation being initiated by nitration of the liquid resulting from contamination with nitrogen dioxide in service, comprising:

preparing, or obtaining a freshly prepared, hydrocarbonaceous liquid suitable for service at bulk liquid temperatures of between 60 and 180° C. and being free of aged components and nitrogen dioxide contamination;

adding to said hydrocarbonaceous liquid, prior to service at bulk liquid temperatures of between 60 and 180° C., an ionic liquid and a detergent additive, wherein:

the ionic liquid is composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and wherein the detergent additive comprises, as the active ingredient, one or more hydrocarbyl-substituted neutral or overbased metal salts;

wherein the ionic liquid and detergent active ingredient are added in amounts that are co-operatively effective to thereafter inhibit the nitration of the hydrocarbonaceous liquid in service at bulk liquid temperatures of between 60 and 180° C., in the presence of nitrogen dioxide contamination; and putting said hydrocarbonaceous liquid into service, wherein the ionic liquid and detergent additive thereby limit the resulting chemical degradation of the liquid.

27. The method of paragraph 26, wherein the chemical degradation is that resulting from the decomposition of hydrocarbonaceous nitrate esters formed in service by the nitration of the hydrocarbonaceous liquid by nitrogen dioxide at bulk liquid temperatures of between 60 and 180° C.; and wherein the ionic liquid and detergent active ingredient are added in amounts determined to inhibit the formation of hydrocarbonaceous nitrate esters in that service.

28. The method of paragraph 27, wherein the decomposition of the hydrocarbonaceous nitrate esters results from the hydrocarbonaceous liquid being periodically or continuously subjected in service to bulk liquid temperatures of between 110 and 160° C.; and wherein the ionic liquid and detergent active ingredient are added in amounts determined to inhibit the formation of hydrocarbonaceous nitrate esters in that service.

29. The method of paragraph 27 or paragraph 28, wherein the inhibition of hydrocarbonaceous nitrate ester formation in service is determined by the observance of a lower nitrate ester peak area in the combined presence of the ionic liquid and detergent active ingredient, as compared with the nitrate ester peaks observed with ionic liquid or detergent active ingredient alone in the same individual amounts, as measured by infrared spectroscopy according to DIN 51 453 or ASTM D8048-20, under like conditions of service and nitrogen dioxide contamination.

30. The method of any of paragraphs 26 to 29, wherein the amounts of ionic liquid and detergent active ingredient added to the hydrocarbonaceous liquid to co-operatively effect the inhibition in nitration are between 0.1-5.0% by weight of ionic liquid, per weight of hydrocarbonaceous liquid, and between 0.2 to 5.0% by weight of detergent active ingredient, per weight of hydrocarbonaceous liquid.

31. The method of any of paragraphs 26 to 30, wherein the ionic liquid and detergent additive are added in the form of the additive composition of paragraph 1, or of any of paragraphs 3 to 24 when read with paragraph 1.

32. The method of any of paragraphs 26 to 31, wherein the hydrocarbonaceous liquid is a lubricating oil.

33. The co-operative use of an ionic liquid and a detergent additive, wherein the ionic liquid is composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

and wherein the detergent additive comprises, as the active ingredient, one or more hydrocarbyl-substituted neutral or overbased metal salts;

to limit the chemical degradation of a hydrocarbonaceous liquid in service at bulk liquid temperatures of between 60 and 180° C., the degradation being initiated by nitration of the hydrocarbonaceous liquid resulting from contamination with nitrogen dioxide during service; wherein the ionic liquid and detergent additive are added to the hydrocarbonaceous liquid free of aged components and nitrogen dioxide prior to service, and wherein the ionic liquid and detergent active ingredient thereafter inhibit the nitration of the hydrocarbonaceous liquid in service at bulk liquid temperatures of between 60 and 180° C. in the presence of nitrogen dioxide contamination.

34. The use of paragraph 33, wherein the ionic liquid and detergent additive are added in the form of the additive composition of paragraph 1, or of any of paragraphs 3 to 24 when read with paragraph 1.

35. The use of a detergent additive comprising, as the active ingredient, one or more hydrocarbyl-substituted neutral or overbased metal salts, to increase the efficacy of an ionic liquid additive for inhibiting the nitration of a hydrocarbonaceous liquid in service at bulk liquid temperatures of between 60 and 180° C. and resulting from contamination with nitrogen dioxide in service, the ionic liquid being composed of:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge;

wherein the detergent additive is added to the hydrocarbonaceous liquid containing the ionic liquid additive prior to service at bulk liquid temperatures of between 60 and 180° C. and exposure to nitrogen dioxide contamination.

36. The use of any of paragraphs 33 to 35, wherein the hydrocarbonaceous liquid is a lubricating oil.

37. The method or use of any of paragraphs 26 to 36, wherein the detergent active ingredient has the features specified in any of paragraphs 18 to 23, and the ionic liquid has the features specified in any of paragraphs 3 to 17.

38. The method or use of any of paragraphs 26 to 37, wherein the detergent active ingredient has the features specified in any of paragraphs 20 to 23.

39. The method or use of any of paragraphs 26 to 38, wherein the ionic liquid has the features specified in any of paragraphs 13 to 17.

40. The method or use of any of paragraphs 26 to 39, wherein the hydrocarbon liquid resulting from the method or use additionally comprises an ashless dispersant additive, and preferably a phosphorus-containing compound.

EXAMPLES

The practice and advantages of the present invention are now illustrated by way of examples.

For purposes of this invention and the claims thereto, determining the amount of reduction or limitation of nitrate ester formation in a lubricating oil composition is determined by the observance of a lower (such as by at least 10%, such by at least 20%, such as by at least 30%, such as by at least 40%, such as by at least 50%, such as by 100%) nitrate ester peak height in the presence of the lubricating oil composition containing ionic liquid (as compared to the nitrate ester peak of the same lubricating oil composition where the ionic liquid is replaced with an ionic liquid having the same cation, but hexanoate as the anion in the same proportions), as measured by infrared spectroscopy according to DIN 51 453 or ASTM D8048-20, under like conditions of service and nitrogen dioxide contamination, provided that in the event of conflicting results between DIN 51 453 and ASTM D8048-20, DIN 51 453 shall control.

Example 1—Preparation of Ionic Liquids for Use in the Worked Examples

Ionic liquids were synthesised using the following method deploying an ion-exchange resin.

Example 1.1: [P66614][Salicylate] (Example of Ionic Liquid Under the Invention)

[P66614][Salicylate] was produced using a two-step synthesis method starting from commercially available trihexyltetradecylphosphonium chloride, [P66614][Cl] (CYPHOS IL-101, >95%, CAS: 258864-54-9).

In the first step, [P66614][OH] was synthesized from [P66614][Cl] using a commercially available basic anion exchange resin (Amberlite IRN-78, OH-form resin, CAS: 11128-95-3). [P66614][Cl] (100 g, 0.193 mol) was added to a 2 L round-bottom flask and diluted with absolute ethanol (900 mL, 19.5 mol, CAS: 64-17-5). To this, 100 g of the ion exchange resin was added, and the mixture was stirred for 5 hours at 22° C. The resin was then filtered off, and 100 g of fresh resin was added. This step was repeated three times, or until a negative silver halide test was observed, indicating complete ion exchange.

The silver halide test was carried out as follows: a small aliquot (0.2 mL) of the reaction mixture was transferred to a 2 mL vial, and diluted with 1 mL absolute ethanol. 2-3 drops of HNO3 were added to acidify the solution, and 2-3 drops of a saturated aqueous solution of AgNO3 (≥99 wt. %, Sigma-Aldrich, CAS: 7761-88-8) was subsequently added. Complete ion exchange was indicated when a transparent solution with no precipitate was observed.

In the second step, the concentration of [P66614][OH] in ethanol was determined using 1H NMR. This was followed by the dropwise equimolar addition of commercially available salicylic acid (≥99.0 wt. %, CAS: 69-72-7) dissolved in 100 mL ethanol (26.6 g, 0.193 mol of salicylic acid for 100% yield), which was subsequently stirred overnight at 22° C. The solution was then dried under rotary evaporation and subsequently in vacuo (10-3 Pa) at 50° C. for a minimum of 96 h, to obtain the dry pure ionic liquid (determined by NMR a follows):

[P66614][Salicylate]: $^{1}$H NMR (500 MHz, DMSO-d$^{6}$): δ (ppm)=0.87 (s, 12H, C$\underline{H}_3$—(P)), 1.24-1.58 (m, 48H, —C$\underline{H}_2$—(P)), 2.17 (s, 8H, —C$\underline{H}_2$—(P)), 6.62 (m, 2H), 7.17 (m, 1H), 7.65 (m, 1H); $^{13}$C NMR (126 MHz, DMSO-d$^{6}$): δ (ppm)=13.86, 13.95, 17.14, 17.28, 17.56, 17.65, 20.50, 21.81, 22.10, 28.08, 28.63, 28.72, 28.96, 29.05, 29.68, 29.80, 30.40, 31.30 116.00, 129.92, 131.97, 162.79, 171.31.

Example 1.2: [P66614][Alkyl-Salicylate] (Example of Ionic Liquid Under the Invention)

[P66614][Alkyl-Salicylate] was synthesised via the procedure used for [P66614][Salicylate] in Example 1.1. [P66614][OH] was firstly prepared from [P66614][Cl] (100 g, 0.193 mol). The alkyl-salicylic acid used in the second step in place of the salicylic acid from Example 1.1 was a commercial sample provided by Infineum UK Ltd, being a mono-alkyl salicylic acid mixture bearing alkyl substituents of 14 and 16 carbon atoms. In this case, the acid number of the salicylic acid (0.00261 g H+/mol) was used to calculate the amount of acid required (equimolar) for the neutralisation reaction, which was 73.96 g.

Following drying the material was characterised via NMR:

[P66614][Alkyl-Salicylate]: $^{1}$H NMR (500 MHz, DMSO-d$^{6}$): δ (ppm)=0.69-0.88 (s), 1.04-1.29 (m), 1.37 (m), 1.46 (m), 2.15 (m), 2.29 (s), 3.34 (s), 3.43 (m), 4.36 (s), 6.49 (m), 6.72 (m), 6.93 (m), 7.18 (m), 7.25 (m), 7.41 (s), 7.47 (m), 7.65 (s), 7.70 (s), 8.16 (s), 9.07 (s), 9.11 (s), 9.15 (s).

A further sample of [P66614][Alkyl-Salicylate] was prepared by the following scaled up procedure.

[P66614][Cl] (808 g, 1.56 mol) was charged into a 5 L glass reactor and diluted with absolute ethanol (770 mL, 13.2 mol). To this solution was dosed a pre-prepared solution of KOH (87.3 g, 1.56 mol) in absolute ethanol (770 mL, 13.2 mol) over 28 minutes using a water bath to limit the exotherm to 23° C. The mixture was aged for between 90 and 250 min and then blended with celite filter aid (164 g, 20 mass %) and filtered to remove KCl, rinsing the filter cake with absolute ethanol (160 mL, 2.74 mol). The filtrate was transferred to a clean 5 L glass reactor and treated with Amberlite ion exchange resin IRN-78 (400 g, 50 mass %) for 30-70 min and then separated by filtration, rinsing the resin with absolute ethanol (2×160 mL, 2×2.74 mol). The filtrate was transferred to a clean 5 L glass reactor, into which was dosed an equimolar amount of the same alkyl-salicylic acid as a xylene solution over 33 min using a water bath to limit the exotherm to 28° C. The mixture was aged for 16 hours and then the volatile components were removed via rotary evaporation at 60-80° C. at 10 mbar for min. 3 h.

Example 1.3: [P66614][Hexanoate] (Example of Ionic Liquid Under the Invention)

[P66614][Hexanoate] was synthesised via the procedure used for [P66614][Salicylate] in Example 1.1. [P66614][OH] was firstly prepared from [P66614][Cl] (100 g, 0.193 mol). Equimolar addition of hexanoic acid (≥99 wt. %, CAS: 142-62-1) in place of salicylic acid in the second step (22.4 g, 0.193 mol) was used to produce the desired ionic liquid, followed by drying.

Example 1.4: [P66614][NTf$_2$] (Comparative Example)

Trihexyltetradecylphosphonium chloride, [P66614][Cl] (100 g, 0.193 mol) was dissolved in a minimum amount of dichloromethane (>99%, CAS: 75-09-2), in a 1 L round-bottom flask. To this, an aqueous solution of commercially available LiNTf2 (55.3 g, 0.193 mol; 99 wt. %, CAS: 90076-65-6) was added dropwise. The reaction mixture was stirred for 12 h at 22° C., forming a biphasic solution. The organic layer was extracted and washed with ultrapure water five times to remove the LiCl by-product, and until a negative halide test was observed. The solution was then dried under rotary evaporation and subsequently in vacuo (10-3 Pa) at 50° C. for a minimum of 96 hours, to obtain dry pure trihexyltetradecylphosphonium bis(trifluoromethanesulfonyl)imide, [P66614][NTf2], determined by NMR as follows:

[P66614][NTf$_2$]: $^{1}$H NMR (500 MHz, CDCl$_3$): δ (ppm)= 0.88 (m, 12H, C$\underline{H}_3$—(P)) 1.23-1.29 (m, 32H, —C$\underline{H}_2$—(P)), 1.46 (m, 16H, —C$\underline{H}_2$—(P)), 2.08 (m, 8H, —C$\underline{H}_2$—(P)); $^{13}$C NMR (126 MHz, CDCl$_3$): δ (ppm)=13.85, 14.12, 18.56, 18.94, 21.55, 22.28, 22.69, 28.80, 29.25, 29.36, 29.49, 29.65, 30.17, 30.52, 30.89, 31.92, 118.62, 121.17.

The ionic liquids prepared by these syntheses were used in the further examples below.

Example 2—Detergent and Dispersant Additives for Use in the Worked Examples

The following further additives were prepared for use in the examples:

Example 2.1: Calcium Alkylsulfonate Detergent, 300 TBN (Detergent Under the Invention)

Example 2.1 was a calcium alkylsulfonate made by reacting alkylsulfonic acid under reflux in toluene with calcium hydroxide in the presence of a small amount of water in methanol, followed by the blowing of carbon dioxide into the reaction vessel and further reflux and a heatsoak period, before base oil dilution and distillation followed by cooling and centrifuging to remove solids, and finishing by removal of solvent under vacuum.

Example 2.2: Calcium Alkylsalicylate Detergent, 350 TBN (Preferred Detergent Under the Invention Example 2.2 was a calcium alkyl-salicylate made by reacting alkyl-salicylic acid under reflux in xylene with calcium hydroxide in the presence of a small amount of water in methanol, followed by the blowing of carbon dioxide into the reaction vessel at the same temperature and further reflux before cooling and centrifuging to remove solids, and finishing by removal of solvent under vacuum. The product was diluted into base oil for easy handling.

Example 2.3: Thermal Polyisobutylene Succinimide Dispersant (Dispersant Under the Invention Example 2.3 was a PIBSA-PAM dispersant made in a two-stage process by firstly reacting 2300 g/mol high reactivity polyisobutylene (PIB) thermally with maleic anhydride to produce PIBSA (polyisobutylene succinic anhydride), and thereafter reacting the PIBSA with N7 polyamine (PAM) containing around 2.3 primary N per mole to produce the resulting dispersant with a nitrogen content of around 1.2% (at 58% active material).

Example 2.4: Zinc Dialkyl Dithiophosphate (Conventional Antioxidant)

Example 2.4 was a ZDDP (zinc dialkyldithiophosphate) made in a two-stage process by firstly reacting a mixture of primary C8 and secondary C4 alcohols with P4S10 to give dialkyldithiophosphoric acid (DDPA), and thereafter reacting the DDPA with a small excess of zinc oxide to form the final ZDDP.

The materials from the above preparative examples were used in the further examples that follow.

Example 3—Evaluation of the Combination of Ionic Liquid and Detergent Additive Under Service Conditions To evaluate the effectiveness of the advantages of the combination of ionic liquid and detergent in the present invention, the onset and progress of nitration in a hydrocarbonaceous liquid subject to nitrogen dioxide contamination can be observed and measured using infrared spectroscopy. The increase in kinematic viscosity and total acid number (TAN) can also be followed under suitable test conditions to observe other advantages of the present invention.

Monitoring the progressing nitration of the hydrocarbonaceous liquid involves taking periodic samples of the liquid in use under real or simulated service conditions, and following the evolution of the fingerprint nitration peak height on the infrared spectrum. The rate of increase of the nitration peak height provides information on the rate of chemical degradation due to nitration and build-up of the nitrate ester reservoir in the bulk liquid.

According to the DIN 51453 peak height method [Standard DIN 51453 (2004-10): Testing of lubricants—Determination of the oxidation and nitration of used motor oils—Infrared spectrometric method], the height of a single infrared absorption frequency at 1630 cm-1 attributable to forming hydrocarbonaceous nitrate ester is measured above a straight-line baseline defined by the absorptions at 1615 and 1645 cm-1. The higher the peak height, the more hydrocarbonaceous nitrate ester is present in the bulk liquid. The above DIN method also provides for monitoring of the progress of conventional oxidation of the bulk liquid via the measurement of peak height at 1710 cm-1 attributable to carbonyl moieties (ketones, aldehydes, esters and carboxylic acids) formed as a result of oxidation. This peak height is measured relative to a straight-line baseline defined by absorptions at 1970 and 1650 cm-1. Again, the rate of increase of peak height provides information on the rate of chemical oxidation in the bulk liquid.

According to ASTM D8048-20 Standard test method for evaluation of diesel engine oils in Volvo (Mack) T-13 diesel engines, oxidation and nitration peak heights are measured by first subtracting the fresh oil infrared spectrum. The baseline is defined by absorption between 1950 cm-1 and 1850 cm-1 with highest peak in the range 1740 cm-1 to 1700 cm-1 used for oxidation and 1640 cm-1 to 1620 cm-1 for nitration.

Samples of hydrocarbonaceous liquid being tested under service conditions can be measured via the above methods, and allow the reporting of the effect of different ionic liquids and detergent present in the hydrocarbonaceous liquid on the progress, and/or level of inhibition, of degradation due to nitration and due to oxidation.

Monitoring the increase in kinematic viscosity and increase in total acid number under test conditions is conducted by test methods ASTM D445 and ASTM D664 respectively.

Example 3.1—Ionic Liquid and Detergent Contribution Towards Inhibiting Degradation Caused by Nitration The DIN 51453 method was used to illustrate the combined contribution of the ionic liquid and detergent in the performance of the present invention.

The following test samples were subjected to a laboratory simulation of service conditions as an engine lubricant, in which the oil was exposed to sump operating temperatures and exposed to a source of nitrogen dioxide to mimic contamination in service. This simulation comprises a three-necked 250 mL conical flask fitted with a glycol condenser and heated on an electrical hot-plate. Gas containing 766 ppm NO2 in air is bubbled through 250 g of the test lubricant at a rate of 10 litres per minute. A sintered glass frit is used to disperse the gas in the oil. The gas flow rate is regulated using a mass flow controller. The third neck is used to introduce a thermocouple which feeds-back to the hotplate to maintain constant temperature. The test samples were each run for 96 hours at 130° C., and the nitration and oxidation peak heights determined at the end of the test by the above DIN 51453 method. The results for the two samples containing ionic liquid were then compared with the control oil formulation, and the impact of their respective ionic liquids reported as percentage reductions in nitration and oxidation peak height against the control.

Testing was conducted on a freshly prepared lubricating oil as bulk hydrocarbonaceous liquid. To this starting base oil composition was added 2% by mass, per mass of the oil, of the detergent Example 2.1 or 2.2, or 5% by mass of the dispersant Example 2.3, or 1% by mass of the conventional antioxidant Example 2.4, to establish baseline effects on nitration and oxidation for these single additives. Baseline effects in the same base oil for the single ionic liquid Example 1.2, Example 1.3 and Example 1.4 were also established at equimolar level, corresponding to a mass % level of 2.8% by mass of Example 1.2, 2.0% by mass of Example 1.3 or 2.55% by mass of Example 1.4. The starting base oil composition was also used as a control run to set the baseline offered by a commercial base oil.

The results are shown in the table below.

Results

| Test | Oil sample tested (all % by mass) | peak height % reduction vs control | |
|---|---|---|---|
| | | Oxidation | Nitration |
| 1 | Base oil (control) | 0.0 | 0.0 |
| 2 | Base oil + Example 2.1 (2%) | −2.8% | 1.1% |
| 3 | Base oil + Example 2.2 (2%) | 4.8% | 12.4% |
| 4 | Base oil + Example 2.3 (5%) | −87.2% | −0.9% |
| 5 | Base oil + Example 2.4 (1%) | 95.1% | 23.2% |
| 6 | Base oil + Example 1.2 (2.8%) | 99.2% | 84.7% |
| 7 | Base oil + Example 1.3 (2.0%) | −5.2% | −4.1% |
| 8 | Base oil + Example 1.4 (2.55%) | 69.4% | −14.9% |
| 9 | Base oil + Example 1.2 (2.8%) + Example 2.1 (2%) | 99.5% | 90.0% |
| 10 | Base oil + Example 1.2 (2.8%) + Example 2.2 (2%) | 99.5% | 93.7% |
| 11 | Base oil + Example 1.3 (2.0%) + Example 2.1 (2%) | 2.9% | −6.1% |
| 12 | Base oil + Example 1.3 (2.0%) + Example 2.2 (2%) | 83.3% | 64.1% |
| 13 | Base oil + Example 1.4 (2.55%) + Example 2.1 (2%) | −8.6% | 0.4% |
| 14 | Base oil + Example 1.4 (2.55%) + Example 2.2 (2%) | 0.8% | 8.9% |
| 15 | Base oil + Example 2.1 (2%) + Example 2.3 (5%) + Example 2.4 (1%) | 4.7% | −6.9% |
| 16 | Base oil + Example 1.2 (2.8%) + Example 2.1 (2%) + Example 2.3 (5%) + Example 2.4 (1%) | 97.6% | 84.4% |
| 17 | Base oil + Example 1.3 (2.0%) + Example 2.1 (2%) + Example 2.3 (5%) + Example 2.4 (1%) | 63.4% | 37.8% |
| 18 | Base oil + Example 1.4 (2.55%) + Example 2.1 (2%) + Example 2.3 (5%) + Example 2.4 (1%) | 21.5% | −0.4% |
| 19 | Base oil + Example 2.2 (2%) + Example 2.3 (5%) + Example 2.4 (1%) | 28.1% | 5.4% |
| 20 | Base oil + Example 1.2 (2.8%) + Example 2.2 (2%) + Example 2.3 (5%) + Example 2.4 (1%) | 97.9% | 92.7% |
| 21 | Base oil + Example 1.3 (2.0%) + Example 2.2 (2%) + Example 2.3 (5%) + Example 2.4 (1%) | 98.3% | 87.7% |
| 22 | Base oil + Example 1.4 (2.55%) + Example 2.2 (2%) + Example 2.3 (5%) + Example 2.4 (1%) | 52.1% | 14.9% |

Considering first the baseline results for detergent, dispersant and phosphorus-based antioxidant (tests 1 to 5), it is evident that dispersant (Example 2.3) shows no benefit per se in nitration control under the test conditions of nitrogen dioxide contamination, and is adverse in the oxidation aspect of the test, leading to a large increase in oxidation peak height (i.e., negative % reduction). Detergent Example 2.1 shows little impact on both oxidation and nitration, whilst detergent Example 2.2 shows a small peak height reduction in both. As expected, the antioxidant Example 2.4 shows strong antioxidancy performance, but gives much less nitration control, evidencing that nitration of the oil proceeds via a different mechanism in which conventional oxidation is not the primary factor.

Considering the results for the equimolar comparisons of ionic liquid alone in base oil (tests 6 to 8), it is evident that ionic liquid Example 1.3 shows no effect by itself in the inhibition of nitration, as compared to the base oil. The preferred ionic liquid Example 1.2 in contrast already shows a very high inhibition of nitration, evidencing its superior performance per se as the preferred ionic liquid, comprising the preferred aromatic carboxylate anion. Against oxidation, preferred Example 1.2 is also very highly active, in contrast to Example 1.3. Halogen- and sulfur-containing ionic liquid Example 1.4 shows significant antioxidancy in contrast to its negative impact on nitration, again evidencing that that nitration of the oil proceeds via a different mechanism.

The co-addition of detergent Example 2.1 or 2.2 to the comparative ionic liquid Example 1.4 (tests 13 and 14) removes the antioxidancy benefit of the ionic liquid alone (test 8), and results in nitration control which is less than that provided by each respective detergent alone (tests 2 and 3). In contrast, the co-addition of each detergent to preferred ionic liquid Example 1.2 (tests 9 and 10) results in a further increase in the already high nitration control, and has no adverse impact on the almost complete antioxidancy effect of this ionic liquid (see test 6). The resulting combinations provide excellent combined control of nitration and also oxidation, offering substantial advantages to the oil formulator seeking to control oil degradation by different mechanisms. The co-addition of the more preferred detergent Example 2.2 also results in very substantial reductions in nitration and antioxidancy with the less preferred ionic liquid Example 1.3 (test 12), although these do not reach the very high levels achieved with ionic liquid Example 1.2. Addition of the less preferred detergent Example 2.1 to less preferred ionic liquid Example 1.3 (test 11) eliminates the pro-oxidancy effect of this ionic liquid alone.

Co-addition of the dispersant (Example 2.3) and antioxidant (Example 2.4) in tests 15 to 22 also showed advantages from the combinations of the invention.

The co-introduction of dispersant and antioxidant with Detergent Example 2.1 (test 15) showed a small pro-nitration effect, and only a small net reduction in oxidation, compared with detergent alone (test 2). This result showed the strong antioxidant effect of Example 2.4 to be almost completely neutralised by the dispersant, and the moderate nitration control of Example 2.4 to be almost eliminated. This binary combination of additional additives when added to the detergent therefore provided nothing significant to nitration control. However, the added co-presence of preferred ionic liquid Example 1.2 (test 16) resulted in an oil with very high antioxidancy and excellent nitration control, which was not likewise negated by the presence of dispersant. Likewise, the co-inclusion of ionic liquid Example 1.3 (test 17) showed strong antioxidancy benefit and appreciable nitration control, even in the presence of dispersant. The combination of ionic liquid and detergent of the present invention thus enables the further inclusion of dispersant, without negating the advantages of the invention towards nitration and oxidation control, allowing the preparation of oil formulations in which dispersant can be incorporated for its beneficial effects without rendering the oil more prone to chemical degradation due to nitration and conventional oxidation. In contrast, the co-inclusion of the halogen- and sulfur-containing ionic liquid Example 1.4 provided no nitration control, and a much lower antioxidant effect.

Likewise, tests 19 to 22 using the more preferred detergent Example 2.2 showed that very high nitration control is obtained by the combination of this detergent and ionic liquid Examples 1.2 and 1.3 (tests 20 and 21), even in the presence of the dispersant, and despite the apparent reduction in baseline net nitration control from Detergent Example 2.2 in the presence of dispersant and conventional antioxidant Example 2.4 (test 19). Again, in contrast, the halogen- and sulfur-containing ionic liquid Example 1.4 provided much lower nitration control and antioxidancy. These preferred formulations thus enable the dispersancy benefits of Example 2.3 to be imparted to the oil, whilst inhibiting nitration of the oil to a high degree in the presence of nitrogen dioxide contamination, and also providing a high antioxidancy benefit.

The superior performance of the ionic liquid Example 1.2 over Example 1.3 is also maintained in these combination tests, confirming ionic liquids of the Example 1.2 type as most preferred. Likewise, the superior effect seen with detergent Example 2.2 over Example 2.1 confirms the Example 2.2 type as most preferred.

Example 3.2—Ionic Liquid and Detergent Contribution Towards Kinematic Viscosity Control The growth in kinematic viscosity (at 40° C.) of hydrocarbon oil under nitrogen dioxide contamination conditions was determined using the standard test method ASTM D445. In brief, according to this standard method, the time taken for a determined volume of liquid to flow under gravity through a calibrated glass capillary viscometer is measured under a reproduceable driving head and at controlled temperature. The kinematic viscosity is determined from the calibration constant of the viscometer and liquid flow times.

Each test run was conducted using the combination of additive Examples listed in the Figure. In each case, the amount of additive Example(s) employed in the oil were the same as in Example 3.1.

The results of testing are shown in FIG. 1 as the kinematic viscosity achieved at the end of the test as a percentage of the viscosity exhibited by the base oil at the end of the test. Thus, a result lower than 100% indicates lower viscosity growth than the base oil, whereas a result higher than 100% indicates higher viscosity growth. Minimising viscosity growth demonstrates the oil is more resistant to degradation under the test conditions.

Reading the results in FIG. 1 from the bottom up, these tests firstly illustrate that detergent Examples 2.1 and 2.2 per se provided a reduction in viscosity growth as compared with the base oil, whereas dispersant Example 2.3 per se gave a slight increase in viscosity. Antioxidant Example 2.4 per se showed a strong reduction in viscosity growth.

Ionic liquid Examples 1.2 and 1.3 per se also both provided a reduction in viscosity growth, with preferred Example 1.2 providing a much larger benefit, which was maintained in the presence of detergent Examples 2.1 and 2.2. The addition of each of these detergents to ionic liquid Example 1.3 brought about a clear further reduction in viscosity growth over this ionic liquid per se, with the preferred detergent Example 2.2 bringing this ionic liquid to virtually the same performance level as the combination comprising preferred ionic liquid Example 1.2. The corresponding binary combinations of detergent and ionic liquid Example 1.4 (comparative) showed lower improvements in viscosity.

The addition of detergent, dispersant and antioxidant to base oil resulted in viscosity increases which, whilst smaller than that seen with the base oil, were still larger than those seen with the antioxidant Example 2.4 alone, indicating the presence of dispersant caused some deactivation of the viscosity control in these combinations. However, the further co-addition of ionic liquid examples 1.2 or 1.3 to these combinations resulted in significant further reductions in viscosity increase, demonstrating that the combinations of the invention showed high levels of viscosity reduction even in the presence of dispersant, enabling dispersant use alongside the viscosity control provided by the ionic liquid and detergent combination.

Example 3.3—Ionic Liquid and Detergent Contribution Towards Total Acid Number Control The growth in total acid number (TAN) of hydrocarbon oil under nitrogen dioxide contamination conditions was determined using the standard test method ASTM D664. In brief, according to this standard method, the test sample is subjected to a potentiometric titration using potassium hydroxide to determine the amount of acidic substance(s) resident in the oil.

Each test run was conducted using the combination of additive Examples listed in the Figure. In each case, the amount of additive Example(s) employed in the oil were the same as in Example 3.1.

The results of testing are shown in FIG. 1 as the TAN achieved at the end of the test as a percentage of the TAN exhibited by the base oil at the end of the test. Thus, a result lower than 100% indicates lower TAN growth than the base oil, whereas a result higher than 100% indicates higher TAN growth. Minimising TAN growth demonstrates the oil is more resistant to increased acidity and consequent degradation under the test conditions.

Reading the results in FIG. 1 from the bottom up, these tests firstly illustrate that detergent Examples 2.1, 2.2 and 2.3 per se provided a reduction in TAN growth as compared with the base oil, and antioxidant Example 2.4 per se showed a strong reduction in TAN growth.

Ionic liquid Examples 1.2 and 1.3 per se also both provided a reduction in TAN growth, with preferred Example 1.2 providing essentially complete control, which was maintained in the presence of detergent Examples 2.1 and 2.2. The addition of each of these detergents to ionic liquid Example 1.3 brought about a clear further reduction in TAN growth over this ionic liquid per se, with the preferred detergent Example 2.2 bringing this ionic liquid close to the performance level of the combination comprising preferred ionic liquid Example 1.2. The corresponding binary combinations of detergent and ionic liquid Example 1.4 (comparative) showed lower improvements in TAN.

The addition of detergent, dispersant and antioxidant to base oil resulted in TAN increases which, whilst smaller than that seen with the base oil, were still larger than those seen with the antioxidant Example 2.4 alone. However, the further co-addition of ionic liquid examples 1.2 or 1.3 to these combinations resulted in significant further reductions in TAN increase, demonstrating that the combinations of the invention showed high levels of viscosity reduction even in the presence of dispersant, enabling dispersant use alongside the TAN control provided by the ionic liquid and detergent combination.

Thus, through these examples, the advantages of the combinations of the present invention are seen in one or more of nitration control, oxidation control, viscosity growth and TAN growth.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" specifies the presence of stated features, steps, integers or components, but does not preclude the presence or addition of one or more other features, steps, integers, components or groups thereof. Likewise, the term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa. Further, when a range is stated as between A and B, the range includes endpoints A and B, thus "between A and B" is synonymous with "from A to B."

What is claimed is:

1. An additive composition for hydrocarbonaceous liquids, the additive composition comprising an ionic liquid and a detergent additive, the ionic liquid comprising:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge; wherein each anion (ii) of the ionic liquid comprises a carboxylate functional group attached to an aliphatic or an aromatic group;

wherein the aliphatic carboxylate functional group is a $C_5$ to $C_{17}$ linear alkyl group, and the aromatic carboxylate functional group is a $C_6$ to $C_{28}$ linear alkyl substituted salicylate;

and the detergent additive comprising a 200 to 450 TBN calcium alkyl salicylate; and wherein when the additive composition is incorporated into hydrocarbonaceous liquids, the ionic liquid comprises from 0.5 to 5.0 wt. % of the overall composition and the detergent additive comprises from 0.5 to 4.0 wt. % of the overall composition.

2. A hydrocarbonaceous liquid composition comprising a major amount of hydrocarbonaceous liquid and a minor amount of the additive composition of claim 1.

3. The composition of claim 1, wherein each cation (i) of the ionic liquid contains nitrogen.

4. The composition of claim 3, wherein each cation (i) consists of a substituted ammonium cation, or an alicyclic or aromatic ring system incorporating nitrogen and bearing the cationic charge.

5. The composition of claim 3, wherein each cation (i) is a tetra-substituted ammonium cation.

6. The composition of claim 1, wherein each cation (i) of the ionic liquid is nitrogen-free.

7. The composition of claim 6, wherein each cation (i) of the ionic liquid consists of a tetra-hydrocarbyl substituted central atom or ring system bearing the cationic charge.

8. The composition of claim 7, wherein each cation (i) of the ionic liquid is a tetra-alkyl substituted phosphonium cation.

9. The composition of claim 1, wherein each anion (ii) of the ionic liquid is nitrogen-free.

10. The composition of claim 1, wherein each anion (ii) of the ionic liquid is a hexanoate anion.

11. The composition of claim 1, wherein each anion (ii) of the ionic liquid further comprises a heteroatom-containing functional group.

12. The composition of claim 10, wherein each cation (i) of the ionic liquid is a trihexyltetradecyl-phosphonium cation.

13. The composition of claim 1, additionally comprising an ashless dispersant additive, and optionally a phosphorus-containing compound.

14. The composition of claim 2, wherein the hydrocarbonaceous liquid is a lubricating oil.

15. A method of limiting the chemical degradation of a hydrocarbonaceous liquid in service at bulk liquid temperatures of between 60 and 180ºC, the degradation being initiated by nitration of the liquid resulting from contamination with nitrogen dioxide in service, comprising:

preparing, or obtaining a freshly-prepared, hydrocarbonaceous liquid suitable for service at bulk liquid temperatures of between 60 and 180° C. and being free of aged components and nitrogen dioxide contamination;

adding to said hydrocarbonaceous liquid, prior to service at bulk liquid temperatures of between 60 and 180° ° C., an ionic liquid and a detergent additive, wherein:

the ionic liquid comprises:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge; wherein each anion (ii) of the ionic liquid comprises a carboxylate functional group attached to an aliphatic group or an aromatic group; wherein the aliphatic carboxylate functional group is a $C_5$ to $C_{17}$ linear alkyl group, and the aromatic carboxylate functional group is a $C_6$ to $C_{28}$ linear alkyl substituted salicylate;

and wherein the detergent additive comprises a 200 to 450 TBN calcium alkyl salicylate;

wherein the ionic liquid is added at from 0.5 to 5.0 wt. % and the detergent additive is added at from 0.5 to 4.0 wt. % the hydrocarbonaceous liquid in service at bulk liquid temperatures of between 60 and 180° C., in the presence of nitrogen dioxide contamination; and putting said hydrocarbonaceous liquid into service, wherein the ionic liquid and detergent additive thereby limit the resulting chemical degradation of the liquid.

16. The method of claim 15, wherein the chemical degradation is that resulting from the decomposition of hydrocarbonaceous nitrate esters formed in service by the nitration of the hydrocarbonaceous liquid by nitrogen dioxide at bulk liquid temperatures of between 60 and 180° C.; and wherein the ionic liquid and detergent active ingredient are added in amounts determined to inhibit the formation of hydrocarbonaceous nitrate esters in that service.

17. The method of claim 16, wherein the decomposition of the hydrocarbonaceous nitrate esters results from the hydrocarbonaceous liquid being periodically or continuously subjected in service to bulk liquid temperatures of between 110 and 160° C.; and wherein the ionic liquid and detergent active ingredient are added in amounts determined to inhibit the formation of hydrocarbonaceous nitrate esters in that service.

18. The method of claim 16, wherein the inhibition of hydrocarbonaceous nitrate ester formation in service is determined by the observance of a lower nitrate ester peak area in the combined presence of the ionic liquid and detergent active ingredient, as compared with the nitrate ester peaks observed with ionic liquid or detergent active ingredient alone in the same individual amounts, as measured by infrared spectroscopy according to DIN 51 453 or ASTM D8048-20, under like conditions of service and nitrogen dioxide contamination.

19. The method of claim 15, wherein the amounts of ionic liquid and detergent additive added to the hydrocarbonaceous liquid to co-operatively effect the inhibition in nitration are between 1.0 to 3.0% by weight of ionic liquid, per weight of hydrocarbonaceous liquid, and between 1.0 to 3.0% by weight of detergent additive, per weight of hydrocarbonaceous liquid.

20. The method of claim 15, wherein each cation (i) consists of a substituted ammonium cation, or an alicyclic or aromatic ring system incorporating nitrogen and bearing the cationic charge.

21. The method of claim 15, wherein each cation (i) is a tetra-substituted ammonium cation or a tetra-alkyl substituted phosphonium cation.

22. The method of claim 15, wherein each anion (ii) of the ionic liquid comprises a further heteroatom-containing functional group.

23. The method of claim 15, additionally comprising an ashless dispersant additive, and, optionally, a phosphorus-containing compound.

24. The method of claim 15, wherein the hydrocarbonaceous liquid is a lubricating oil.

25. A method for the co-operative use of an ionic liquid and a detergent additive to limit the chemical degradation of a hydrocarbonaceous liquid in service at bulk liquid temperatures of between 60 and 180° C., the degradation being initiated by nitration of the hydrocarbonaceous liquid resulting from contamination with nitrogen dioxide during service, wherein the ionic liquid comprises:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge; wherein each anion (ii) of the ionic liquid comprises a carboxylate functional group attached to an aliphatic group or an aromatic group; wherein the aliphatic carboxylate functional group is a $C_5$ to $C_{17}$ linear alkyl group, and the aromatic carboxylate functional group is a $C_6$ to $C_{28}$ linear alkyl substituted salicylate;

and wherein the detergent additive comprises a 200 to 450 TBN calcium alkyl salicylate, as the active ingredient, wherein the ionic liquid is added at from 0.5 to 5.0 wt. % and detergent additive is added at from 0.5 to 4.0 wt. % to the hydrocarbonaceous liquid free of aged components and nitrogen dioxide prior to service, and wherein the ionic liquid and detergent active ingredient thereafter inhibit the nitration of the hydrocarbonaceous liquid in service at bulk liquid temperatures of between 60 and 180° C. in the presence of nitrogen dioxide contamination.

26. A method to increase the efficacy of an ionic liquid additive comprising adding 0.5 to 4.0 wt. % detergent additive to a hydrocarbonaceous liquid containing 0.5 to 5.0 wt. % ionic liquid additive prior to service at bulk liquid temperatures of between 60 and 180° C. and exposure to nitrogen dioxide contamination, wherein the detergent additive comprises a 200 to 450 TBN calcium alkyl salicylate, as the active ingredient, and the ionic liquid comprises: ionic liquid (i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge; wherein each anion (ii) of the ionic liquid comprises a carboxylate functional group attached to an aliphatic group or an aromatic group; wherein the aliphatic carboxylate functional group is a $C_5$ to $C_{17}$ linear alkyl group, and the aromatic carboxylate functional group is a $C_6$ to $C_{28}$ linear alkyl substituted salicylate;

wherein the efficacy of the ionic liquid additive for inhibiting the nitration of a hydrocarbonaceous liquid in service at bulk liquid temperatures of between 60 and 180° C. and resulting from contamination with nitrogen dioxide in service is increased.

27. The method of claim 26, wherein the hydrocarbonaceous liquid is a lubricating oil.

28. The method of claim 15, wherein the hydrocarbon liquid resulting from the method additionally comprises an ashless dispersant additive, and optionally a phosphorus-containing compound.

29. A hydrocarbonaceous liquid composition comprising a major amount of hydrocarbonaceous liquid an ionic liquid at from 0.5 to 5.0 wt. % and a detergent additive at from 0.5 to 4.0 wt. %, the ionic liquid comprising:

(i) one or more organic cations each comprising a central atom or ring system bearing the cationic charge and multiple pendant hydrocarbyl substituents, and (ii) one or more halogen-, sulfur- and boron-free organic anions each comprising one or more hydrocarbyl groups and one or more heteroatom-containing functional groups bearing a localised or delocalised anionic charge; wherein each anion (ii) of the ionic liquid comprises a carboxylate functional group attached to an aliphatic group or an aromatic group;

wherein the aliphatic carboxylate functional group is a $C_5$ to $C_{17}$ linear alkyl group, and the aromatic carboxylate functional group is a $C_6$ to $C_{28}$ linear alkyl substituted salicylate;

and the detergent additive comprising a 200 to 450 TBN calcium alkyl salicylate, as active ingredient.

30. The composition of claim 2, wherein the hydrocarbonaceous liquid is a crankcase lubricating oil for an internal combustion engine.

31. The method of claim 21, wherein each cation (i) is a trihexyltetradecyl-phosphonium cation.

* * * * *